US011959684B2

(12) United States Patent
Filatau et al.

(10) Patent No.: US 11,959,684 B2
(45) Date of Patent: Apr. 16, 2024

(54) COOLING DEVICE

(71) Applicant: Huawei Digital Power Technologies Co., Ltd., Shenzhen (CN)

(72) Inventors: Sviataslau Alehavich Filatau, Minsk (BY); Yongqi Qiu, Dongguan (CN)

(73) Assignee: HUAWEI DIGITAL POWER TECHNOLOGIES CO., LTD., Shenzhen (CN)

( * ) Notice: Subject to any disclaimer, the term of this patent is extended or adjusted under 35 U.S.C. 154(b) by 314 days.

(21) Appl. No.: 17/456,996

(22) Filed: Nov. 30, 2021

(65) Prior Publication Data

US 2022/0364769 A1 Nov. 17, 2022

Related U.S. Application Data

(63) Continuation of application No. PCT/BY2021/000007, filed on May 12, 2021.

(51) Int. Cl.

| | |
|---|---|
| ***F25B 41/00*** | (2021.01) |
| ***F25B 5/04*** | (2006.01) |
| ***F25B 39/00*** | (2006.01) |
| ***F25B 41/20*** | (2021.01) |
| ***F25B 41/31*** | (2021.01) |

(Continued)

(52) U.S. Cl.

CPC ..... *F25B 5/04* (2013.01); *F25B 39/00* (2013.01); *F25B 41/20* (2021.01); *F25B 41/31* (2021.01); *F25B 49/02* (2013.01); *F25B 2400/0411* (2013.01); *F25B 2600/2501* (2013.01); *F25B 2600/2513* (2013.01); *F25B 2700/2101* (2013.01)

(58) Field of Classification Search

CPC ..... F25B 5/04; F25B 1/31; F25B 1/20; F25B 39/00; F25B 49/02; F25B 2400/0411; F25B 2600/2501; F25B 2600/2513; F25B 2700/2101

USPC ..... 62/197

See application file for complete search history.

(56) References Cited

U.S. PATENT DOCUMENTS

| | | | |
|---|---|---|---|
| 6,023,935 | A | 2/2000 | Okazaki et al. |
| 8,881,541 | B2 | 11/2014 | Noll et al. |
| 9,968,013 | B2 | 5/2018 | Cacho Alonso |

(Continued)

FOREIGN PATENT DOCUMENTS

| | | | |
|---|---|---|---|
| CN | 104976838 | B | 4/2019 |
| CN | 110030752 | A | 7/2019 |

(Continued)

*Primary Examiner* — Davis D Hwu

(74) *Attorney, Agent, or Firm* — WOMBLE BOND DICKINSON (US) LLP

(57) ABSTRACT

A cooling device comprising a cooling circuit, is described. The cooling circuit further comprises a compressor adapted to compress cooling agent present in the cooling circuit during an active cooling mode, wherein the compressed cooling agent contains lubricant oil from the compressor; a condensing unit connected to the compressor by a first fluid line of the cooling circuit; and an evaporating unit, which is connected to the condensing unit by a second fluid line of the cooling circuit. The cooling circuit further comprises an expansion device arranged in the second fluid line; and an additional evaporator connected to the evaporating unit by a third fluid line of the cooling circuit, and connected to the compressor by a fourth fluid line of the cooling circuit.

19 Claims, 13 Drawing Sheets

(51) Int. Cl.
*F25B 49/00* (2006.01)
*F25B 49/02* (2006.01)

(56) References Cited

U.S. PATENT DOCUMENTS

| | | | |
|---|---|---|---|
| 10,292,303 | B2 | 5/2019 | Cacho Alonso et al. |
| 2009/0126390 | A1* | 5/2009 | Park ..... F25D 23/126 220/565 |
| 2020/0329585 | A1 | 10/2020 | Fuller et al. |

FOREIGN PATENT DOCUMENTS

| | | | |
|---|---|---|---|
| DE | 102015105500 | B3 | 9/2016 |
| EP | 3722720 | A1 | 10/2020 |
| EP | 3723461 | A1 | 10/2020 |
| JP | 2005147623 | A | 6/2005 |
| KR | 20080079957 | A | 9/2008 |
| KR | 101955997 | B1 | 3/2019 |
| WO | 2003095906 | | 11/2003 |
| WO | 2015193952 | A1 | 12/2015 |
| WO | 2016103593 | A1 | 6/2016 |
| WO | 2020176746 | A1 | 9/2020 |

* cited by examiner

COOLING DEVICE

CROSS-REFERENCE TO RELATED APPLICATIONS

This application is a continuation of International Application No. PCT/BY2021/000007, filed on May 12, 2021, the disclosure of which is hereby incorporated by reference in its entirety.

TECHNICAL FIELD

The disclosure relates to a cooling device. More specifically, the disclosure relates to a cooling device comprising a cooling circuit as well as to a method for cooling by using a cooling circuit of a cooling device, and in particular to a cooling device configured to operate in an active and a passive cooling mode.

BACKGROUND

A cooling device comprising a cooling circuit is commonly used, for example in heating, ventilation, and air conditioning devices (HVAC), to reduce the temperature in a room and/or a cabinet. During an active cooling mode of such cooling device, the flow of cooling agent within the cooling circuit is driven by a compressor of the cooling circuit, which compresses the cooling agent. Such a compressor can be an oil-lubricated compressor, wherein lubricant oil is used to lubricate moving parts of the compressor.

During a passive cooling mode, the compressor can be switched off for energy saving, and the flow of cooling agent within the cooling circuit is driven by the force of gravity according to the principle of a loop thermosiphon.

However, during an active cooling mode in commonly used cooling devices lubricant oil is adapted to be transferred together with the compressed cooling agent to elements of the cooling circuit, which are located downstream of the compressor, for example to a condensing unit, an expansion device, and/or an evaporator of the cooling circuit. The transferred lubricant oil might be deposited within the elements, for example within the condensing unit and/or evaporator and might therefore reduce the efficiency of heat exchange performed by the condensing unit and/or evaporator, and for example within the expansion device and might therefore block the flow of cooling agent through the expansion device.

Lubricant oil is hereby dissolved in the liquid phase of the cooling agent, which leads to an increase of viscosity. The flow of liquid cooling agent with increased viscosity leads to significantly increasing the flow resistance of the liquid cooling agent. This phenomenon mostly affects the operation of the cooling device during a passive cooling mode. If the content of lubricant oil at the condensing unit, evaporator and the corresponding connecting tubes is high, the force of gravity could be not enough to support the circulation of cooling agent during the passive cooling mode, and thereby the thermal performance of such passive cooling mode is very limited.

In conventional cooling devices oil separating elements can be used, in order to separate lubricant oil from the cooling agent circulating in the cooling circuit. For example, in U.S. Pat. No. 6,023,935 A such an oil separating element is disclosed.

However, any conventional oil separating element is not able to separate 100% of lubricant oil from the cooling agent, so that lubricant oil can anyway migrate and be retained at heat exchangers, especially at the evaporator.

Conventional evaporators of cooling devices with an active cooling mode of operation are designed with a reduced flow cross section in order to achieve a high flow velocity of the mixture of cooling agent and lubricant oil, so the high speed stream of gaseous cooling agent can push retained lubricant oil towards the compressor. But evaporators with reduced flow cross section are not applicable to cooling devices with a passive cooling mode of operation, because at the passive cooling mode the force of gravity is not enough to overcome the flow resistance of channels with the reduced flow cross section.

Replacing of the evaporator with reduced flow cross section by an evaporator with large flow cross section is suitable for operation of cooling device with passive cooling mode, but in this case the flow velocity of cooling agent is decreased, so the low speed stream of gaseous cooling agent at the evaporator cannot push the lubricant oil towards the compressor, so the lubricant oil is retained at the evaporator and affects the thermal performance during the passive cooling mode due to increasing the viscosity of the cooling agent.

Therefore, it would be desirable to have a cooling device that alleviates the problems of the prior art.

SUMMARY

It is an objective of the disclosure to provide a cooling device with the ability to operate during an active cooling mode and a passive cooling mode, the cooling device comprising a cooling circuit as well as a method for cooling by using a cooling circuit of a cooling device, wherein the cooling device and the method for cooling are configured such that the return of lubricant oil from the evaporator of a cooling device is possible, while the evaporator is suitable for operating in a passive cooling mode due to a low pressure drop, which reduces the flow cross section.

The foregoing and other objectives are achieved by the subject matter of the independent claims. Further implementation forms are apparent from the dependent claims, the description, and the figures.

According to a first aspect a cooling device comprising a cooling circuit is provided, the cooling circuit comprising a compressor, which is adapted to compress cooling agent present in the cooling circuit during an active cooling mode, wherein the compressed cooling agent contains lubricant oil from the compressor; a condensing unit, which is connected to the compressor by a first fluid line of the cooling circuit; an evaporating unit, which is connected to the condensing unit by a second fluid line of the cooling circuit; an expansion device, which is arranged in the second fluid line; an additional evaporator, which is connected to the evaporating unit by a third fluid line of the cooling circuit, and which is connected to the compressor by a fourth fluid line of the cooling circuit, the cooling device being configured so that during the active cooling mode lubricant oil is adapted to be transferred from the compressor through the condensing unit, through the expansion device, through the evaporating unit, through the additional evaporator and through the fourth fluid line back to the compressor; a first fluid by-pass line, which connects the condensing unit with the evaporating unit; and a second fluid by-pass line, which connects the evaporating unit with the condensing unit, wherein the first fluid by-pass line comprises a first by-pass valve and wherein the second fluid by-pass line comprises a second by-pass valve, which are adapted to close the first fluid by-pass line and the second fluid by-pass line in the active cooling mode, respectively.

Therefore, the technical advantage is achieved that by using an evaporating unit and an additional evaporator in the cooling circuit the effectivity of evaporation of the cooling agent flowing through the cooling circuit can be effectively increased and a stable return of lubricant oil from the evaporating unit to the compressor is achieved. In an embodiment, by using two separate evaporating units in the cooling circuit a two-stage evaporation occurs. In a first stage of the evaporation process only a partial evaporation of the liquid cooling agent occurs in the evaporating unit, which results in a partially evaporated liquid cooling agent, which is adapted to flow further to the additional evaporator, wherein in the second stage of the evaporation process a complete evaporation of the partially evaporated liquid cooling agent in the additional evaporator occurs.

Due to the partial evaporation of the liquid cooling agent in the evaporating unit the resulting partially evaporated liquid cooling agent contains two phases, which is liquid cooling agent and gaseous cooling agent. Any liquid lubricant oil, which is released by the compressor into the cooling agent during the active cooling mode is dissolved in the liquid cooling agent present in the evaporating unit. Therefore, the lubricant oil, which is dissolved in the liquid cooling agent, is adapted to be conducted from the evaporating unit to the additional evaporator, thereby avoiding the formation of any deposit of lubricant oil in the evaporating unit. Due to the lack of deposits of lubricant oil in the evaporating unit the evaporating unit can be effectively used during a passive cooling mode, in which the cooling agent is recycled between the condensing unit and the evaporating unit through the first and second by-pass line without the assistance of the compressor.

When the liquid lubricant oil, which is dissolved in the liquid cooling agent present in the evaporating unit, is adapted to be transferred to the additional evaporator a complete evaporation of the partially evaporated liquid cooling agent occurs at the additional evaporator. Therefore, after the complete evaporation only a gaseous cooling agent remains in the additional evaporator, which results in that any lubricant oil, which has been dissolved in the liquid cooling agent, is separated from the cooling agent and forms particles of lubricant oil within the additional evaporator.

However, due to the pressure exerted on the formed particles of lubricant oil by the gaseous cooling agent, the particles of lubricant oil are flushed out the additional evaporator by the gaseous cooling agent into the fourth fluid line and further to the compressor, thereby effectively returning the lubricant oil to the compressor.

In an embodiment, a cross-section of the additional evaporator, e.g., at least one evaporating tube of the additional evaporator, is smaller than a cross-section of the evaporating unit, e.g., at least one evaporating tube of the evaporating unit, so that an increased velocity stream of gaseous cooling agent is adapted to effectively push the particles of lubricant oil from the additional evaporator into the fourth fluid line.

In an embodiment, the lubricant oil, which is adapted to be released from the compressor together with the compressed cooling agent, is recycled back to the compressor through the first fluid line, through the condensing unit, through the second fluid line, through the expansion device, through the evaporating unit, through the third fluid line, through the additional evaporator and through the fourth fluid line. Thereby, the formation of any disadvantageous deposits of lubricant oil within the condensing unit, within the expansion device, within the evaporating unit and/or within the additional evaporator is prevented or at least significantly reduced.

In an embodiment, the evaporating unit and/or the additional evaporator comprise at least one evaporating tube, respectively, so when the liquid cooling agent with the lubricant oil dissolved therein is adapted to flow through the at least one evaporating tube, during the evaporation process a phase separation between the liquid lubricant oil and the obtained gaseous cooling agent is observed, wherein the phase separation is at least partial in the at least one evaporating tube of the evaporating unit, and wherein the phase separation is complete in the at least one evaporating tube of the additional evaporator.

If the at least one evaporating tube extends from a top part of the additional evaporator to a bottom part of the additional evaporator the flow of liquid cooling agent within the at least one evaporating tube is facilitated by the force of gravity and by the pressure, which is applied to the liquid lubricant oil by the gaseous cooling agent, thereby supporting the movement of liquid lubricant oil from the additional evaporator into the fourth fluid line, and through the fourth fluid line back to compressor.

Therefore, the lubricant oil released by the compressor is continuously recycled back to the compressor.

Moreover, the first fluid by-pass line, which directly connects the condensing unit with the evaporating unit, bypasses the second fluid line, and the second fluid by-pass line, which directly connects the evaporating unit with the condensing unit, functions as a by-pass in respect to the additional evaporator and the compressor in a passive cooling mode, wherein in the passive cooling mode the compressor is adapted to be deactivated and the circulation of cooling agent within the cooling circuit is driven by a reduced ambient temperature and gravitational forces according to the principle of a loop thermosiphon.

In an embodiment, the cooling device is not limited to any specific cooling application, but is adapted to cool any media, for example ambient air, liquid from an additional cooling circuit of another cooling device, a solid element, which generates heat, or any other solid or liquid material. Therefore, a cooling device according to the disclosure may comprise heating, ventilation, and air conditioning devices (HVAC). In an embodiment, the cooling device is adapted to cool a cabinet, for example a server cabinet, for example by directly cooling servers within the server cabinet or for example by cooling air within the server cabinet thereby indirectly cooling the servers.

In an embodiment, the cooling agent in the cooling circuit may comprise any conventionally used cooling agent, for example water, isobutane, tetrafluorethane and the like. In an embodiment, the cooling agent can be present in the cooling circuit in two phases, for example in a liquid and in a gaseous phase. At lower temperatures and/or higher pressure the cooling agent is typically present in the liquid phase, while at higher temperatures and/or lower pressure, the cooling agent is typically present in the gaseous state. The cooling agent may be present in the cooling circuit as a mixture of liquid and gaseous phase.

In an embodiment, the compressor is positioned in the cooling circuit downstream of the additional evaporator. In an embodiment, the compressor is adapted to compress gaseous cooling agent in the cooling circuit during the active cooling mode.

In an embodiment, the active cooling mode is characterized in that the compressor is adapted to be activated and is adapted to compress gaseous cooling agent, which results in an increase of temperature of the cooling agent and in a pressure gradient within the cooling circuit, which pressure gradient drives the circulation of cooling agent within the cooling circuit, and which pressure gradient is generated by active work performed by the compressor.

In an embodiment, the compressed gaseous cooling agent contains liquid particles of lubricant oil, wherein the gaseous cooling agent and liquid particles of lubricant oil form a two-phase mixture which is adapted to be transferred from the compressor through the first fluid line to the condensing unit.

In an embodiment, the compressor can be combined with auxiliary components, e.g., valves, receivers, liquid separators, oil separators, additional heat exchangers, filters, control units, sensors, and the like.

In an embodiment, the condensing unit is positioned in the cooling circuit downstream of the compressor. The condensing unit is adapted to condensate the compressed cooling agent, e.g., compressed gaseous cooling agent, by dissipating heat from the cooling agent, in order to obtain liquid cooling agent.

In an embodiment, in the condensing unit the liquid particles of lubricant oil are dissolved in the obtained liquid cooling agent, thereby forming a one-phase mixture, wherein the one-phase mixture of lubricant oil and liquid cooling agent is adapted to be transferred from the condensing unit through the second fluid line and through the expansion device to the evaporating unit.

In an embodiment, the condensing unit comprises at least one condensing tube for conducting the cooling agent through the condensing unit. In an embodiment, the condensing unit may comprise any condensing unit, which is adapted to allow for a condensation of the cooling agent.

In an embodiment, the condensing unit comprises an inlet, which is connected to the first fluid line, and an outlet, which is connected to the second fluid line. In an embodiment, the condensing unit comprises at least one condensing tube or channel, which connects the inlet with the outlet.

In an embodiment, the condensing unit can be combined with auxiliary components, e.g., valves, receivers, liquid separators, oil separators, additional heat exchangers, filters, control units, sensors, and the like.

In an embodiment, the condensing unit is formed as a condenser, which comprises a top part, a bottom part, and a plurality of condensing tubes, e.g., vertically oriented condensing tubes, wherein the condensing tubes connect the top part with the bottom part.

In an embodiment, the top part, the bottom part, and/or the plurality of condensing tubes are connected to the compressor by the first fluid line. In an embodiment, the first fluid line connects the compressor with the top part of the condenser.

In an embodiment, the top part, the bottom part, and/or the plurality of condensing tubes are connected to the evaporating unit by the second fluid line. In an embodiment, the second fluid line connects the bottom part of the condenser with the evaporating unit.

In an embodiment, the heat dissipation from the condensing unit is provided by a flow of ambient air, which temperature is lower than the temperature of the cooling agent entering the condensing unit, to allow for a heat transfer from the cooling agent flowing through the condensing unit to the ambient air.

The second fluid line comprises the expansion device, which is adapted to expand the liquid cooling agent exiting the condensing unit and flowing through the second fluid line, in order to obtain expanded liquid cooling agent, wherein the evaporating unit is adapted to at least partially evaporate the expanded liquid cooling agent.

In an embodiment, the expansion device can be a thermal expansion valve, an electronic expansion valve, a capillary tube, an ejector, a turbine, a ball valve, an orifice and/or a porous plug.

In an embodiment, the evaporating unit is positioned in the cooling circuit downstream of the expansion device and upstream of the additional evaporator.

In an embodiment, the additional evaporator is positioned in the cooling circuit downstream of the evaporating unit and upstream of the compressor.

In an embodiment, the evaporating unit and/or additional evaporator is formed as an evaporator and/or additional evaporator, respectively, which comprises a top part, a bottom part, and a plurality of evaporating tubes, e.g., vertically oriented evaporating tubes, wherein the evaporating tubes connect the top part with the bottom part.

In an embodiment, the second fluid line connects the condensing unit, e.g., a bottom part of the condensing unit, with a bottom part of the evaporating unit.

In an embodiment, the third fluid line connects the evaporating unit, e.g., a top part of the evaporating unit, with the additional evaporator, e.g., a top part of the additional evaporator.

In an embodiment, the fourth fluid line connects the additional evaporator, e.g., a bottom part of the evaporating unit, with the compressor.

In an embodiment, the heat supply to the evaporating unit and/or additional evaporator is provided by a flow of ambient air, which temperature is higher than the temperature of the cooling agent entering the evaporating unit and/or additional evaporator, to allow for a heat transfer from the ambient air to the cooling agent flowing through the evaporating unit and/or additional evaporator.

In an embodiment, the evaporating unit and/or additional evaporator comprises a plurality of vertically oriented evaporating tubes, which connect the bottom part with the top part of the evaporating unit and/or additional evaporator. In an embodiment, the vertical arrangement is characterized by an vertical axis of the plurality of vertically oriented evaporating tubes, which extends between a bottom housing part of the cooling device and a top housing pat of the cooling device.

In an embodiment, the evaporating unit and/or additional evaporator can be combined with auxiliary components, in particular valves, receivers, liquid separators, oil separators, additional heat exchangers, filters, control units, sensors, and the like.

In an embodiment, the first and second by-pass valve are formed as a two-way by-pass valve, respectively, either opening the respective by-pass line in the passive cooling mode or closing the respective by-pass line in the active cooling mode.

However, in an embodiment, the second by-pass valve is adapted to at least partially close the second fluid by-pass line in the active cooling mode. The at least partial closure of the second fluid by-pass line may comprise a complete closure of the second fluid by-pass line by the second by-pass valve, thereby completely sealing off the second fluid by-pass line in the active cooling mode.

Alternatively, the at least partial closure of the second fluid by-pass line may comprise a partial closure of the second fluid by-pass line in the active cooling mode, so that during the active cooling mode lubricant oil, which together with the compressed cooling agent is adapted to flow from the compressor to the condensing unit may be collected in the second fluid by-pass line, thereby reducing the amount of lubricant oil, which is circulated in the cooling circuit.

In an embodiment, the partial closure, e.g. partial opening, of the second fluid by-pass line can be achieved by a periodical opening of the second by-pass valve to allow for a flow of lubricant oil from into the second fluid by-pass line at specific points in time. Alternatively, in an embodiment, the partial closure, e.g. partial opening, of the fluid by-pass line can be achieved by a constant partial opening of the second fluid by-pass line to allow for a constant flow of lubricant oil into the second fluid by-pass line with a limited flow rate.

Due to the partial closure, e.g. partial opening of the second by-pass valve, lubricant oil can flow from the second fluid by-pass line and through the third fluid line to the suction port of the compressor, thereby allowing for an alternative path for a constant return of lubricant oil to the compressor.

In an embodiment of the first aspect, in the active cooling mode the compressor is adapted to compress gaseous cooling agent, wherein the compressed gaseous cooling agent is adapted to be conducted together with the lubricant oil through the first fluid line to the condensing unit, wherein the condensing unit is adapted to condensate the compressed gaseous cooling agent, in order to obtain liquid cooling agent, wherein the obtained liquid cooling agent is adapted to be conducted together with the lubricant oil through the second fluid line and through the expansion device to the evaporating unit, wherein the evaporating unit is adapted to at least partially evaporate the liquid cooling agent, in order to obtain a mixture of gaseous and liquid cooling agent, wherein the obtained mixture of gaseous and liquid cooling agent is adapted to be conducted together with the lubricant oil through the third fluid line to the additional evaporator, wherein the additional evaporator is adapted to completely evaporate the liquid cooling agent in order to obtain gaseous cooling agent, wherein the obtained gaseous cooling agent is adapted to be conducted through the fourth fluid line back to the compressor.

By employing two evaporating units, an effective two-stage evaporation of the cooling agent and a stable lubricant oil return to the compressor can be ensured.

In an embodiment, the least partial evaporation of the liquid cooling agent by the evaporating unit can comprise a partial evaporation of the liquid cooling agent resulting in a two-phase mixture of liquid cooling agent and gaseous cooling agent, wherein the liquid lubricant oil is adapted to be dissolved in the liquid cooling agent.

In an embodiment, the least partial evaporation of the liquid cooling agent by the evaporating unit can comprise a complete evaporation of the liquid cooling agent resulting in a two-phase mixture of gaseous cooling agent as a first phase and the liquid lubricant oil as a second phase.

In an embodiment, after the complete evaporation of cooling agent in the additional evaporator the resulting cooling agent is present in a two-phase mixture of gaseous cooling agent as a first phase and the liquid lubricant oil as a second phase.

In an embodiment of the first aspect, in the active cooling mode the first by-pass valve and the second by-pass valve are adapted to completely close the first fluid by-pass line and the second fluid by-pass line, respectively, or wherein in the active cooling mode the first by-pass valve is adapted to completely close the first fluid by-pass line and the second by-pass valve is adapted to partially close the second fluid by-pass line, by decreasing the cross-section of the second fluid by-pass line between 1% and 99%.

In an embodiment, in the active cooling mode the second by-pass valve is adapted to partially close the second fluid by-pass line by decreasing the cross-section of the second fluid by-pass line between 50% and 99%, more particular in a range between 75% and 99%, even more particular in a range between 85% and 99%, and most particular in a range between 95% and 99%.

In an embodiment, in the active cooling mode the second by-pass valve is adapted to partially close the second fluid by-pass line by decreasing the cross-section of the second fluid by-pass line by 10%, 20%, 30%, 40%, 50%, 60%, 70%, 80%, 90%, 95%, 98% or 99%.

By partially closing, i.e. by partially opening the second fluid by-pass line, during the active cooling mode lubricant oil, which is present in the two-phase mixture flowing from the compressor to the condensing unit, can be collected in the second fluid by-pass line.

In an embodiment of the first aspect, in a passive cooling mode the compressor is adapted to be deactivated, wherein in the passive cooling mode the first by-pass valve and the second by-pass valve are adapted to open the first fluid by-pass line and the second fluid by-pass line, respectively, wherein in the passive cooling mode the cooling agent is adapted to directly flow from the condensing unit through the first fluid by-pass line, through the evaporating unit, and through the second fluid by-pass line back to the condensing unit.

In an embodiment, in the passive cooling mode the cooling agent is adapted to directly flow from the condensing unit through the first fluid by-pass line, through the evaporating unit, and through the second fluid by-pass line back to the condensing unit.

In an embodiment, during the active cooling mode the direction of flow of the lubricant oil and cooling agent through the evaporating unit is opposite to the direction of flow of the cooling agent through the evaporating unit during the passive cooling mode.

In an embodiment of the first aspect, the cooling device comprises a control, wherein the third fluid line or the additional evaporator comprises a first sensor arrangement, which is adapted to detect a superheat of the cooling agent flowing through the third fluid line or through the additional evaporator, and wherein the control is adapted to operate the expansion device and/or the first by-pass valve in dependence of the detected superheat of the cooling agent.

In an embodiment, the control is adapted to operate the expansion device in dependence of the detected superheat of the cooling agent.

In an embodiment, the control is adapted to operate the first by-pass valve in dependence of the detected superheat of the cooling agent.

In an embodiment, the control is adapted to operate the expansion device and the first by-pass valve in dependence of the detected superheat of the cooling agent.

In an embodiment, the first sensor arrangement comprises a pressure sensor, which is adapted to detect a pressure of the cooling agent flowing through the third fluid line and/or the additional evaporator.

In an embodiment, the first sensor arrangement comprises a temperature sensor, which is adapted to detect a temperature of the cooling agent flowing through the third fluid line and/or the additional evaporator.

In an embodiment, the first sensor arrangement comprises both a pressure sensor and a temperature sensor.

In an embodiment, the control is adapted to switch the expansion device and/or the first by-pass valve in an at least partially closed state to increase the flow rate of cooling agent, if the superheat is detected, wherein the superheat in particular is defined by $\Delta T1=T1-TS1$. T1 is the temperature of the cooling agent in the third fluid line and/or the additional evaporator as measured by the temperature sensor of the first sensor arrangement. TS1 is the evaporation temperature of the cooling agent inside the third fluid line and/or the additional evaporator, wherein the control is adapted to determine TS1 based on the pressure of the cooling agent in the third fluid line and/or in the additional evaporator, wherein the pressure is measured by the pressure sensor of the first sensor arrangement.

In other words, the control is adapted to switch the expansion device and/or the first by-pass valve in an at least partially closed state to increase the flow rate of cooling agent, if the detected superheat is above 0, it means in case of $\Delta T1>0$. If $\Delta T1=0$ or $\Delta T1<0$, the flow rate in particular is not changed.

In other words, the control is adapted to change the flow rate of the cooling agent in such way, that a superheated state of the cooling agent in the third fluid line or/and in additional evaporator will be avoided.

By this adaptive regulation of the flow rate of the cooling agent through the evaporating unit and the additional evaporator the evaporation performance of the evaporating unit and the additional evaporator can be adjusted in a way that the cooling agent will not be present in a superheated state at the third fluid line and/or at an intermediate point of additional evaporator. In other words, by this adaptive regulation of the flow rate of cooling agent through the evaporating unit and the additional evaporator the evaporation performance of the evaporating unit and the additional evaporator can be adjusted in a way that the cooling agent will not be in a fully evaporated state at the third fluid line and/or at the intermediate point of the additional evaporator.

In an embodiment of the first aspect, the cooling device comprises a control, wherein the third fluid line comprises a first sensor arrangement, which is adapted to detect a void fraction X of cooling agent flowing through the third fluid line, and wherein the control is adapted to operate the expansion device and/or the first by-pass valve in dependence of the detected void fraction X of cooling agent.

In an embodiment, the void fraction of the cooling agent flowing through the third fluid line corresponds to the vapor fraction of the cooling agent through the third fluid line. In an embodiment, it is desirable to operate the expansion device in such a way, that the void fraction, i.e. vapor fraction, of the cooling agent flowing through the third fluid line is less than 1, thereby indicating that the cooling agent flowing through the third fluid line comprises liquid cooling agent.

In an embodiment, the control is adapted to switch the expansion device and/or the first by-pass valve in an at least partially closed state to decrease the flow rate of cooling agent, if the detected void fraction X is below a void fraction reference XR (void fraction threshold).

In an embodiment, the control is adapted to switch the expansion device and/or the first by-pass valve in an at least partially closed state to increase the flow rate of cooling agent, if the detected void fraction X is above a void fraction reference XR (void fraction threshold).

In an embodiment, the value of XR is selected from the range of 0 to 1, and in particular the value of XR depends on particular design of the evaporating unit and the additional evaporator.

In an embodiment of the first aspect, the fourth fluid line comprises a second sensor arrangement, which is adapted to detect a superheat of the cooling agent flowing through the fourth fluid line, and wherein the control is adapted to operate the expansion device and/or the first by-pass valve in dependence of the detected superheat.

In an embodiment, the control is adapted to operate the expansion device in dependence of the detected superheat of the cooling agent flowing through the fourth fluid line.

In an embodiment, the control is adapted to operate the first by-pass valve in dependence of the detected superheat of the cooling agent flowing through the fourth fluid line.

In an embodiment, the control is adapted to operate the expansion device and the first by-pass valve in dependence of the detected superheat of the cooling agent flowing through the fourth fluid line.

In an embodiment, the second sensor arrangement comprises a pressure sensor, which is adapted to detect a pressure of the cooling agent flowing through the fourth fluid line.

In an embodiment, the second sensor arrangement comprises a temperature sensor, which is adapted to detect a temperature of the cooling agent flowing through the fourth fluid line.

In an embodiment, the second sensor arrangement comprises both a pressure sensor and a temperature sensor.

In an embodiment, the control is adapted to switch the expansion device and/or first by-pass valve in at least partially closed state to reduce the flow rate of cooling agent, if the detected superheat is below an additional superheat threshold, wherein the additional superheat threshold in particular is defined by □T2=T2−TS2. TS2 is the saturation temperature of the cooling agent in the fourth fluid line, which is determined based on the pressure of the cooling agent in the fourth fluid line, wherein the pressure is measured by the pressure sensor of the second sensor arrangement. T2 is the temperature of the cooling agent flowing through the fourth fluid line, which is measured by the temperature sensor of the second sensor arrangement.

In an embodiment, the control is adapted to switch the expansion device and/or first by-pass valve in at least partially opened state to increase the flow rate of cooling agent, if the detected superheat is above an additional superheat threshold, wherein the additional superheat threshold in particular is defined by □T2=T2−TS2. TS2 and T2 are defined as summarized above.

In an embodiment, TS2 is determined based on the pressure of the cooling agent in the third fluid line, wherein the pressure is measured by the pressure sensor of the first sensor arrangement.

In an embodiment, TS1 is determined based on the pressure of the cooling agent in the fourth fluid line, wherein the pressure is measured by the pressure sensor of the second sensor arrangement.

By this adaptive regulation of the flow rate of the cooling agent through the evaporating unit and the additional evaporator the evaporation performance of the evaporating unit and the additional evaporator can be adjusted in a way that the superheat of the cooling agent at the outlet of additional evaporator, i.e. inlet of compressor, is as close as possible to the superheat threshold and that the cooling agent does not have any superheated state at the third fluid line and/or at an intermediate point of additional evaporator, in order to allow for an in particular effective evaporation process, as well as for a reliable operation of the compressor, since the gaseous cooling agent should be at superheated state before entering the compressor for a reliable operation, and the cooling agent should not be in any superheated state after the evaporating unit for a stable transport of liquid cooling agent with dissolved lubricant oil from the evaporating unit to the additional evaporator and to the compressor.

In an embodiment of the first aspect, the evaporating unit comprises a top part, a bottom part, and a plurality of evaporating tubes connecting the top part with the bottom part, wherein the bottom part is connected to the condensing unit by the second fluid line, and wherein the top part is connected to the third fluid line.

In an embodiment, the bottom part of the evaporating unit comprises an inlet tube, which is connected to the second fluid line. In an embodiment, the top part of the evaporating unit comprises an outlet tube, which is connected to the third fluid line.

In an embodiment of the first aspect, the additional evaporator comprises an inlet, which is connected to the third fluid line, and wherein the additional evaporator comprises an outlet, which is connected to the fourth fluid line, wherein the inlet is connected to the outlet of the additional evaporator by at least one evaporating tube of the additional evaporator.

The design of the additional evaporator allows for a high flow velocity because of a small flow cross section of the at least one evaporating tube. The high velocity of vapor inside such additional evaporator leads to entrainment of lubricant oil particles and/or films from the wall surface of the at least one evaporating tube and the movement of lubricant oil together with gaseous cooling agent to the outlet of the additional evaporator.

In an embodiment, the mass velocity of cooling agent flowing through the additional evaporator is greater than the mass velocity of cooling agent flowing through the evaporating unit.

In an embodiment, the mass velocity of the cooling agent flowing through the additional evaporator is large enough to push the oil particles and/or films to the outlet of the additional evaporator and further to the compressor.

In an embodiment, the at least one evaporating tube of the additional evaporator comprises a single evaporating tube. In an embodiment, after complete evaporation of the cooling agent in the additional evaporator, the lubricant oil is transferred through the single evaporating tube of the additional evaporator by the pressure of the gaseous cooling agent. In an embodiment, the evaporating tube of the additional evaporator is formed as a meander-shaped evaporating tube.

In an embodiment of the first aspect, the additional evaporator comprises a top part, a bottom part, and a plurality of evaporating tubes connecting the top part with the bottom part, wherein the top part or bottom part of the additional evaporator is connected to the evaporating unit by the third fluid line, and wherein the bottom part or top part of the additional evaporator is connected to the compressor by the fourth fluid line.

In an embodiment, the additional evaporator comprises a plurality of vertically oriented evaporating tubes. In an embodiment, after complete evaporation of the cooling agent in the additional evaporator, the lubricant oil is transferred downwards through the plurality of evaporating tubes by gravity.

Thereby, the liquid cooling agent with the lubricant oil dissolved therein is adapted to enter the top part of the additional evaporator, and while being adapted to flow through the plurality of evaporating tubes, the liquid cooling agent is completely evaporated thereby forming gaseous cooling agent, which results in a phase separation between the formed gaseous cooling agent and the lubricant oil, which maintains its liquid phase.

Since the cooling agent is adapted to flow from the top part of the additional evaporator through the plurality of evaporating tubes downwards to the bottom part of the additional evaporator, after the phase separation the lubricant oil is pushed downwards in the plurality of evaporating tubes and out of the bottom part of the additional evaporator by the force of gravity and by the pressure exerted on the lubricant oil by the flow of the cooling agent. Consequently, no lubricant oil remains in the additional evaporator.

In an embodiment of the first aspect, the bottom part of the additional evaporator is connected to the evaporating unit by the third fluid line, wherein the top part of the additional evaporator is connected to the compressor by the fourth fluid line, the cooling circuit further comprising an oil release line, which connects the bottom part of the additional evaporator with the fourth fluid line, wherein the oil release line comprises a flow restricting element or oil release valve, which is adapted to close the oil release line in order to retain lubricant oil in the bottom part of the additional evaporator, and to open the oil release line, so that lubricant oil is adapted to flow from the bottom part of the additional evaporator through the oil release line into the fourth fluid line.

By the oil release valve or flow restricting element of the oil release line a controlled release of lubricant oil from the additional evaporator into the fourth fluid line can be ensured.

In an embodiment of the first aspect, the additional evaporator is formed as a regenerative heat exchanger, comprising a first flow-path, which connects a first condensing section of the second fluid line with a second condensing section of the second fluid line, and comprising a second flow-path, which connects the third fluid line with the fourth fluid line, wherein the regenerative heat exchanger is adapted to transfer heat from the cooling agent flowing through the first flow-path to the cooling agent flowing through the second flow-path.

A regenerative heat exchanger is a particularly effective arrangement of the additional evaporator, since heat of the warm liquid cooling agent exiting the condensing unit and flowing through the first flow path can be transferred to the second flow path of the cooling agent, so the complete evaporation of the cooling agent flowing through the second flow path required less energy, thereby increasing the energy efficiency of the additional evaporator and allowing for potentially smaller sizes of the additional evaporator.

In an embodiment of the first aspect, the evaporating unit and/or the additional evaporator comprises a plurality of evaporating fins.

In an embodiment of the first aspect, the cooling circuit further comprises a third fluid by-pass line, which connects the evaporating unit with the additional evaporator, wherein the third fluid by-pass line comprises a flow-restricting element.

In an embodiment, the flow-restricting element in particular comprises a capillary tube, a valve and/or an orifice.

In an embodiment of the first aspect, the third fluid by-pass line connects the evaporating unit with a bottom part of the additional evaporator, with an outlet of the additional evaporator or with an outlet of the additional evaporator, which is formed as a regenerative heat exchanger.

In an embodiment of the first aspect, the third fluid by-pass line connects the evaporating unit with at least one of the plurality of evaporating tubes of the additional evaporator, with the at least one evaporating tube of the additional evaporator, or with the second flow path of the additional evaporator, which is formed as a regenerative heat exchanger.

In an embodiment of the first aspect, during the active cooling mode the second fluid by-pass line is adapted to transfer lubricant oil from condensing unit back to the compressor.

According to a second aspect a method for cooling by using a cooling circuit of a cooling device is provided, wherein the cooling circuit comprises a compressor, a condensing unit, which is connected to the compressor by a first fluid line of the cooling circuit, an evaporating unit, which is connected to the condensing unit by a second fluid line of the cooling circuit, an expansion device, which is arranged in the second fluid line, an additional evaporator, which is connected to the evaporating unit by a third fluid line of the cooling circuit, and which is connected to the compressor by a fourth fluid line of the cooling circuit, a first fluid by-pass line, which connects the condensing unit with the evaporating unit, and a second fluid by-pass line, which connects the evaporating unit with the condensing unit, wherein the first fluid by-pass line comprises a first by-pass valve, and wherein the second fluid by-pass line comprises a second by-pass valve, the method comprising the following operations:

closing of the first fluid by-pass line in an active cooling mode by the first by-pass valve, closing of the second fluid by-pass line in the active cooling mode by the second by-pass valve, compressing cooling agent present in the cooling circuit during the active cooling mode by the compressor, wherein the compressed cooling agent contains lubricant oil from the compressor, and transferring lubricant oil from the compressor through the condensing unit, through the expansion device, through the evaporating unit, through the additional evaporator and through the fourth fluid line back to the compressor in the active cooling mode.

In an embodiment of the second aspect, the method comprises the following operations, opening of the first fluid by-pass line in a passive cooling mode by the first by-pass valve, and opening of the second fluid by-pass line in the passive cooling mode by the second by-pass valve, so that the cooling agent directly flows from the condensing unit through the first fluid by-pass line to the evaporating unit, and through the second fluid by-pass line back to the condensing unit.

In an embodiment of the second aspect, the method comprises the following operation, partially opening of the second fluid by-pass line in the active cooling mode by the second by-pass valve, so that lubricant oil is transferred from the condensing unit back to the compressor.

Details of one or more examples are set forth in the accompanying drawings and the description below. Other features, objects, and advantages will be apparent from the description, drawings, and claims.

BRIEF DESCRIPTION OF THE DRAWINGS

In the following, examples of the disclosure are described in more detail with reference to the attached figures and drawings, in which.

In the following, identical reference signs refer to identical or at least functionally equivalent features.

DETAILED DESCRIPTION OF THE EXAMPLES

In the following description, reference is made to the accompanying figures, which form part of the disclosure, and which show, by way of illustration, specific aspects of examples of the disclosure or specific aspects in which examples of the disclosure may be used. It is understood that examples of the disclosure may be used in other aspects and comprise structural or logical changes not depicted in the figures. The following detailed description, therefore, is not to be taken in a limiting sense, and the scope of the disclosure is defined by the appended claims.

For instance, it is to be understood that a disclosure in connection with a described method may also hold true for a corresponding device or system configured to perform the method and vice versa. For example, if one or a plurality of specific method operations are described, a corresponding device may include one or a plurality of units, e.g. functional units, to perform the described one or plurality of method operations (e.g. one unit performing the one or plurality of operations, or a plurality of units each performing one or more of the plurality of operations), even if such one or more units are not explicitly described or illustrated in the figures. On the other hand, for example, if a specific apparatus is described based on one or a plurality of units, e.g. functional units, a corresponding method may include one operation to perform the functionality of the one or plurality of units (e.g. one operation performing the functionality of the one or plurality of units, or a plurality of operations each performing the functionality of one or more of the plurality of units), even if such one or plurality of operations are not explicitly described or illustrated in the figures. Further, it is understood that the features of the various examples and/or aspects described herein may be combined with each other, unless specifically noted otherwise.

Figure 1:
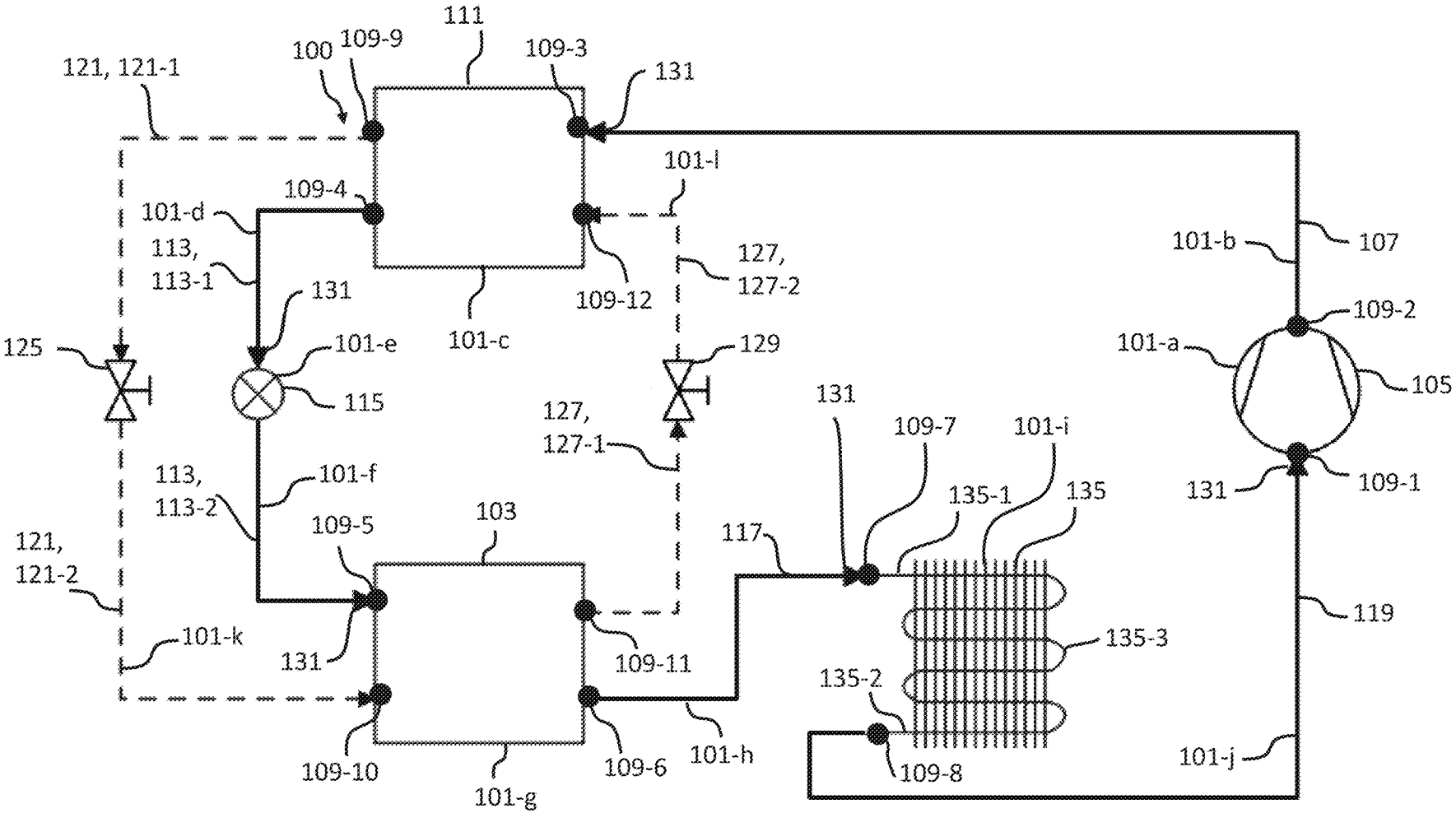
FIG. 1 is a schematic diagram of a cooling device comprising a cooling circuit during an active cooling mode according to an example.

FIG. 1 is a schematic diagram of a cooling device 100 comprising a cooling circuit 101 during an active cooling mode according to an example.

The cooling device 100, which is only schematically shown in FIG. 1, is not limited to any specific cooling application, but is adapted to cool any media, for example ambient air, liquid from an additional cooling circuit of another cooling device, a solid element, which generates heat, or any other solid or liquid material. Therefore, heating, ventilation, and air conditioning devices (HVAC) are comprised by a cooling device 100 according to the example.

Only as an example, the cooling device 100 according to the example is adapted to cool a cabinet, for example a server cabinet, which for example directly cools servers within the exemplary server cabinet or which for example cools the air within the exemplary server cabinet, thereby indirectly cooling the servers.

As illustrated in FIG. 1, the cooling circuit 101 of the cooling device 100 comprises inter alia a compressor 105, a condensing unit 111, an expansion device 115, an evaporating unit 103 and an additional evaporator 135, which are fluidically connected within the cooling circuit 101. A cooling agent, for example tetrafluorethane, is flowing through the cooling circuit 101. The cooling agent is characterized in that it can be present in the cooling circuit 101 in two phases, e.g. in a liquid and in a gaseous phase. At lower temperatures and/or higher pressure the cooling agent is typically present in the liquid phase, while at higher temperatures and/or lower pressure, the cooling agent is typically present in the gaseous phase.

In the following the cooling circuit 101 of the cooling device 100 is described, wherein in particular reference to an active cooling mode is provided.

The compressor 105 forms a first section 101-*a* of the cooling circuit 101. The compressor 105 is positioned in the cooling circuit 101 downstream of the additional evaporator 135. The compressor is adapted to compress the gaseous cooling agent during the active cooling mode, in order to obtain compressed gaseous cooling agent. During compression, the compressor 105, which is driven by electrical and/or mechanical energy, pressurizes the gaseous cooling agent thereby allowing for an increase of temperature of the cooling agent and for an active flow of the compressed gaseous cooling agent further downstream through the cooling circuit 101.

In this respect, it is mentioned that the compressor 105 is formed as an oil-lubricated compressor 105, which is characterized in that its moving parts are lubricated by lubricant oil to reduce friction. However, during compression, at least a part of the lubricant oil, which is present in the compressor 105, can be transported together with the compressed gaseous cooling agent further downstream in the cooling circuit 101.

At a first connection point 109-1, the compressor 105, which forms a first section 101-*a* of the cooling circuit 101, is connected to a fourth fluid line 119 of the cooling circuit 101. At a second connection point 109-2, the compressor 105 is connected to a first fluid line 107 of the cooling circuit 101, wherein the first fluid line 107 forms a second section 101-*b* of the cooling circuit 101. The first fluid line 107 is adapted to transfer the compressed gaseous cooling agent from the compressor 105 to the condensing unit 111, wherein the condensing unit 111 forms a third section 101-*c* of the cooling circuit 101. The first fluid line 107 is connected to the condensing unit 111 at a third connection point 109-3.

The condensing unit 111, which is positioned in the cooling circuit 101 downstream of the compressor 105, is adapted to condensate the compressed cooling agent by dissipating heat from the cooling agent, in order to obtain liquid cooling agent.

The heat dissipating from the condensing unit 111 typically is adapted to be transferred to a flow of ambient air, which temperature is lower than the temperature of the cooling agent entering the condensing unit 111, to allow for a heat transfer from the cooling agent flowing through the condensing unit 111 to the ambient air. To enable an efficient heat dissipation, the condensing unit 111 in particular comprises extended surface areas, which for example can comprise at least one condensing tube, a top part of the condensing unit 111, a bottom part of the condensing unit 111, and/or condensing fins.

At a fourth connection point 109-4, the condensing unit 111 is connected to a first section 113-1 of a second fluid line 113 of the cooling circuit 101, wherein the first section 113-1 of the second fluid line 113 forms a fourth section 101-*d* of the cooling circuit 101. The first section 113-1 of the second fluid line 113 is adapted to transfer the liquid cooling agent from the condensing unit 111 to the expansion device 115, which forms a fifth section 101-*e* of the cooling circuit 101.

The expansion device 115 is positioned in the cooling circuit 101 downstream of the condensing unit 111 and upstream of the evaporating unit 103. The expansion device 115 is adapted to expand the liquid cooling agent, in order to obtain expanded liquid cooling agent, wherein the expanded liquid cooling agent can comprise a two-phase mixture of gaseous and liquid cooling agent. The expansion device 115 can be a thermal expansion valve, an electronic expansion valve, a capillary tube, an ejector, a turbine, a ball valve, an orifice and/or a porous plug.

A second section 113-2 of the second fluid line 113 of the cooling circuit 101, which forms a sixth section 101-*f* of the cooling circuit 101, connects the expansion device 115 with the evaporating unit 103, e.g., at a fifth connection point 109-5. The evaporating unit 103 forms a seventh section 101-*g* of the cooling circuit 101 and is adapted to at least partially evaporate the expanded liquid cooling agent in the active cooling mode by supplying heat to the cooling agent, thereby obtaining a two-phase mixture of liquid and gaseous cooling agent.

At a sixth connection point 109-6, the evaporating unit 103 is connected to the third fluid line 117 of the cooling circuit 101, wherein the third fluid line 117 forms an eighth section 101-*h* of the cooling circuit 101. The third fluid line 117 is adapted to transfer the at least partially evaporated cooling agent from the evaporating unit 103 to the additional evaporator 135, e.g., to an inlet 135-1 of the additional evaporator 135, wherein the additional evaporator 135 forms a ninth section 101-*i* of the cooling circuit 101.

At an eight connection point 109-8, an outlet 135-2 of the additional evaporator 135 is connected to the fourth fluid line 119, which forms a tenth section 101-*j* of the cooling circuit 101 thereby closing the cooling circuit 101.

The additional evaporator 135 is adapted to completely evaporate the at least partially evaporated cooling agent flowing from the evaporating unit 103 into the additional evaporator 135 by supplying heat to the cooling agent, in order to obtain a gaseous cooling agent.

As can be derived from FIG. 1, the additional evaporator 135 comprises the inlet 135-1, which is connected to the outlet 135-2 by a single evaporating tube 135-3, which is formed as a meander-shaped single evaporating tube 135-3.

The heat supply to the evaporating unit 103 and/or additional evaporator 135 typically is provided by a flow of ambient air, which temperature is higher than the temperature of the cooling agent flowing through the evaporating unit 103 and/or additional evaporator 135, to allow for a heat transfer from the ambient air to the cooling agent flowing through the evaporating unit 103 and/or additional evaporator 135. To enable an efficient heat transfer, the evaporating unit 103 and/or the additional evaporator 135 comprises extended surface areas, which can comprise optional evaporating fins.

At a ninth connection point 109-9, the condensing unit 111 is connected to a first fluid by-pass line 121 of the cooling circuit 101, which forms eleventh section **101-*k* of the cooling circuit 101, wherein the first fluid by-pass line 121 comprises a first by-pass valve 125, which is adapted to close the first fluid by-pass line 121 in the active cooling mode. The first fluid by-pass line 121 is connected to the bottom part 103-2 of the evaporator 103 at a tenth connection point 109-10, wherein the first fluid by-pass line 121** will be explained in more detail further below.

At an eleventh connection point 109-11, the evaporating unit 103 is connected to a second fluid by-pass line 127 of the cooling circuit 101, which forms a twelfth section **101-*l* of the cooling circuit 101, wherein the second fluid by-pass line 127 comprises a second by-pass valve 129, which is adapted to close the second fluid by-pass line 127 in the active cooling mode. The second fluid by-pass line 127 joins the condensing unit 111 at a twelfth connection point 109-12. The second fluid by-pass line 127** will be explained in more detail further below.

The above described active cooling mode of the cooling is typically required when the temperature of ambient air, which corresponds to air contacting the condensing unit, is above or close to the temperature of air inside the cabinet, which corresponds to air flowing from the evaporator to the cabinet. The active cooling mode requires the active work of the compressor 105 and thereby consumes electrical energy.

During the active cooling mode, the compressor 105 of the cooling circuit 101 is activated, the first by-pass valve 125 is adapted to close the fluid by-pass line 121, and the second by-pass valve 129 is adapted to at least partially close the second fluid by-pass line 127.

Therefore, during the active cooling mode the cooling agent is adapted to be transferred from the compressor 105, through the first fluid line 107, through the condensing unit 111, through the first section 113-1 of the second fluid line 113, through the expansion device 115, through the second section 113-3 of the second fluid line 113, through the evaporating unit 103, through the third fluid line 117, through the inlet 135-1 of the additional evaporator 135, through the evaporating tube 135-3 of the additional evaporator 135, through the outlet 135-2 of the additional evaporator 135, and through the fourth fluid line 119 back to the compressor 105.

The circulation between vapor and liquid phases of the cooling agent within the cooling circuit 101 during the active cooling mode is enabled by active work from the compressor 105, in combination with the expansion of liquid cooling agent at the expansion device 115.

The corresponding direction of flow of the cooling agent 131 in the active cooling is marked with solid arrows in FIG. 1. The direction of flow of the cooling agent in the passive cooling is marked with dashed arrows in FIG. 1.

As mentioned above, due to employing an oil-lubricated compressor 105, oil particles can be transferred together with the compressed gaseous cooling agent from the compressor 105 to other components of the cooling circuit 101, which are located downstream of the compressor 105, for example to the condensing unit 111, to the expansion device 115, to the evaporating unit 103 and/or to the additional evaporator 135.

Deposits of lubricant oil within for example the evaporating unit 103, the additional evaporator 135 and/or condensing unit 111 might impair the efficiency of heat transfer with the ambient air, and deposits of lubricant oil within for example the expansion device 115 might restrict the flow of cooling agent through the expansion device 115. Moreover, the presence of dissolved lubricant oil in the liquid phase of the cooling agent, leads to an increase in the viscosity of the cooling agent and to a significant increase of the flow resistance. At such condition, the force of gravity is not enough for an efficient circulation and the thermal performance of the cooling device 100 during the passive cooling mode is poor.

The example of the present invention allows for an efficient prevention of deposits of lubricant oil within the condensing unit 111, the expansion device 115, the evaporating unit 103 and/or the additional evaporator 135 as summarized in the following.

The compressed gaseous cooling agent together with liquid lubricant oil forms a two-phase mixture, which is adapted to flow from the compressor 105 through the first fluid line 107 into the condensing unit 111. At the condensing unit 111 during condensation the gaseous cooling agent is transformed into liquid cooling agent, wherein the liquid lubricant oil is adapted to be dissolved in the obtained liquid cooling agent, thereby forming a one-phase mixture.

The one-phase mixture comprising liquid cooling agent and the liquid lubricant oil dissolved therein is adapted to be conducted through the second fluid line 113 and is expanded in the expansion device 115 before the one-phase mixture is adapted to enter the evaporating unit 103.

When the one-phase mixture subsequently is adapted to flow through the evaporating unit 103, the liquid cooling agent is partially evaporated, thereby forming a two-phase mixture of liquid cooling agent and gaseous cooling agent, wherein the liquid lubricant oil is dissolved in the liquid cooling agent.

The two-phase mixture of liquid cooling agent and gaseous cooling agent, wherein the liquid lubricant oil is dissolved in the liquid cooling agent, flows from the evaporating unit 103 through the third fluid line 117 into the additional evaporator 135, wherein the two-phase mixture is completely evaporated in the evaporating tube 135-3 of the additional evaporator 135 resulting in the presence of exclusively gaseous cooling agent and phase-separated liquid lubricant oil, which is formed in the evaporating tube 135-3 as lubricant oil particles.

Since the direction of flow of the two-phase mixture of gaseous cooling agent and liquid lubricant oil within the evaporating tube 135-3 is aligned to the force of gravity acting on the liquid lubricant oil particles and with the pressure exerted on the liquid oil particles by the gaseous cooling agent, the movement of the liquid oil particles from the evaporating tube 135-3 to the outlet 135-2 of the additional evaporator 133 is efficiently supported, thereby preventing any deposits of lubricant oil within the evaporating tube 135-3, e.g., by pushing the lubricant oil particles into the fourth fluid line 119 and further to the compressor 105, which is achieved by a small diameter of the evaporating tube 135-3.

Therefore, due to the design of the additional evaporator 135 any lubricant oil exiting the compressor 105 together with the cooling agent during the active cooling mode is recycled back to the compressor 105. Therefore, a stable return of lubricant oil from the additional evaporator 135 to the compressor 105 is ensured.

In case, the temperature of ambient air, which corresponds to air contacting the condensing unit, is below the temperature of air inside the cabinet, which corresponds to air flowing from the evaporator to the cabinet, a passive cooling mode can be applied. In the passive cooling mode, the compressor 105 is adapted to be deactivated for energy saving, and the circulation of the cooling agent through the cooling circuit 101 is provided by the principle of a loop thermosiphon. The function of the passive cooling mode is described in respect to the example of FIG. 2.

Figure 2:
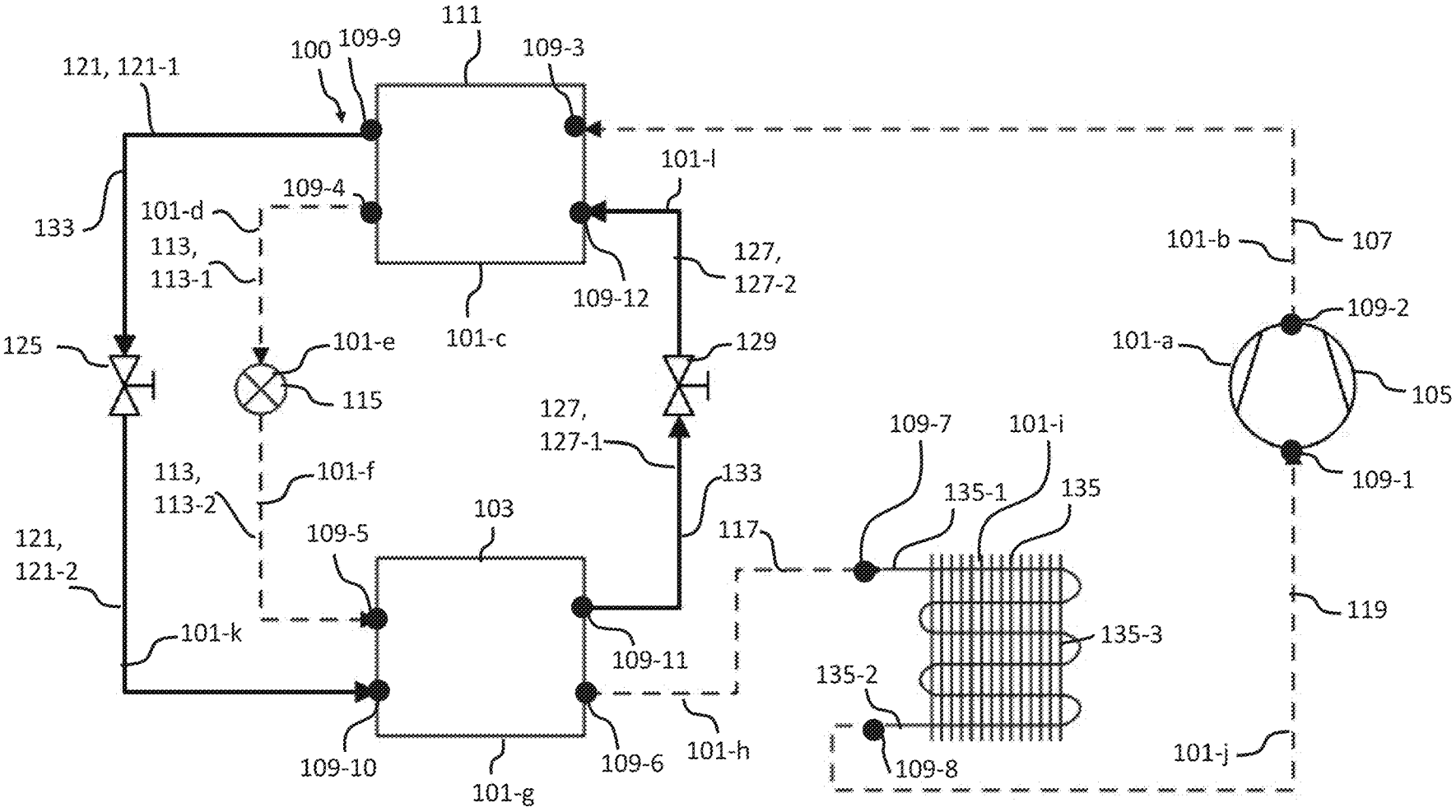
FIG. 2 is a schematic diagram of a cooling device comprising a cooling circuit during a passive cooling mode according to an example.

FIG. 2 is a schematic diagram of a cooling device 100 comprising a cooling circuit 101 during a passive cooling mode according to an example.

The cooling circuit 101 depicted in FIG. 2 is identical to the cooling circuit 101 depicted in FIG. 1 except for the passive cooling mode applied.

During the passive cooling the first by-pass valve 125 is adapted to open the first fluid by-pass line 121, so that during the passive cooling mode the liquid cooling agent is adapted to flow from the condensing unit 111 through the first fluid by-pass line 121 into the evaporating unit 103, in which the liquid cooling agent is evaporated thereby obtaining gaseous cooling agent.

During the passive cooling mode, the compressor 105 of the cooling circuit 101 is adapted to be deactivated and the second by-pass valve 129 is adapted to open the second fluid by-pass line 127, so that during the passive cooling mode the gaseous cooling agent, which has been evaporated in the evaporating unit 103, is adapted to flow from evaporating unit 103 through the second fluid by-pass line 127 to the condensing unit 111. In the condensing unit 111 the gaseous cooling agent is liquefied, in order to obtain liquid cooling agent again, thereby closing the passive cooling cycle.

The corresponding direction of flow of the cooling agent 133 in the passive cooling mode is marked with solid arrows in FIG. 2. The direction of flow of the cooling agent in the active cooling is marked with dashed arrows in FIG. 2.

The circulation between vapor and liquid phases of the cooling agent between the condensing unit 111 and the evaporating unit 103 during the passive cooling mode is enabled by the natural flow of the cooling agent due to gravitational forces.

Further, during the passive cooling mode, oil migration of lubricant oil through the cooling circuit 101 is not significant, because the compressor 105 is adapted to be deactivated and the main volume of lubricant oil is maintained at the compressor 105.

Figure 3:
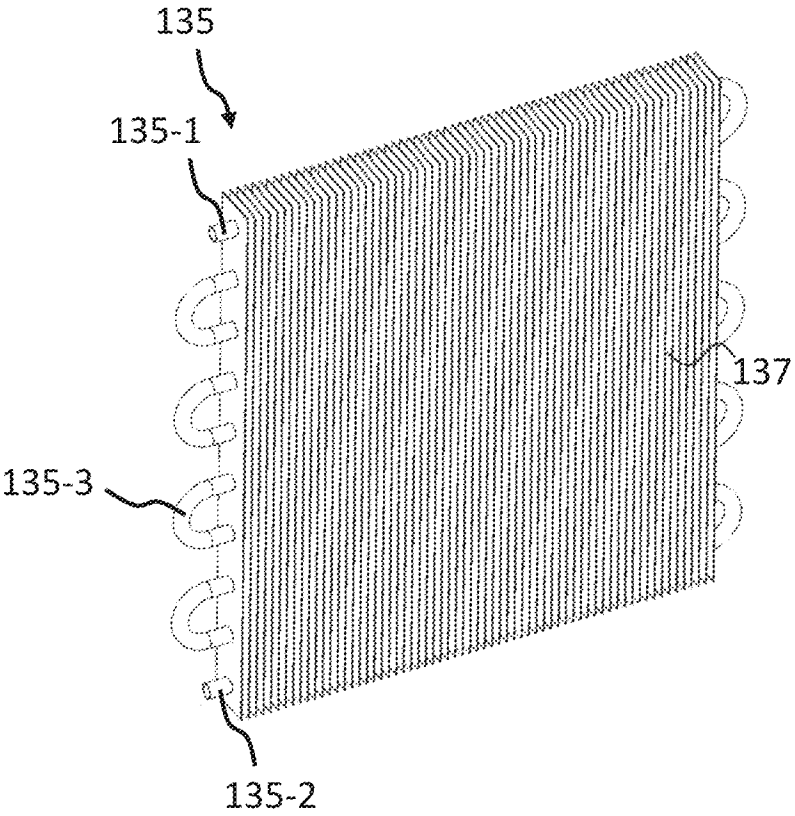
FIGS. 3A and 3B are schematic diagrams of an evaporating unit and an additional evaporator of a cooling circuit according to an example.
Figure 3:
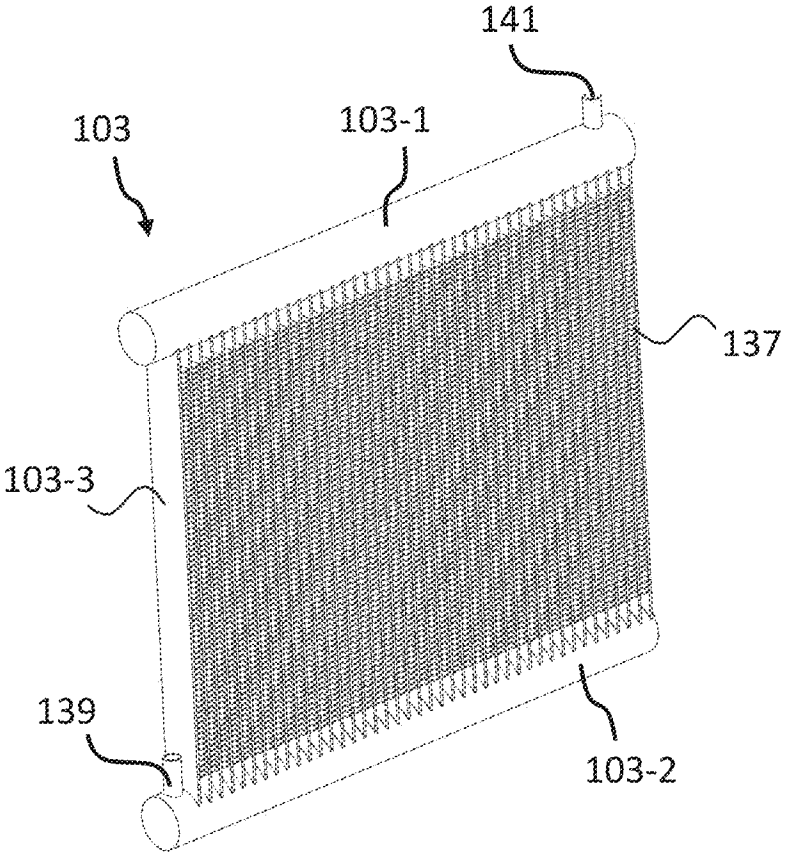

FIGS. 3A and 3B are schematic diagrams of an evaporating unit and an additional evaporator of a cooling circuit according to an example.

In an embodiment, the evaporating unit 103 shown in FIG. 3A corresponds to the evaporating unit 103 shown in FIGS. 1 and 2. In an embodiment, the additional evaporator 135 shown in FIG. 3B corresponds to the additional evaporator 135 shown in FIGS. 1 and 2.

The evaporating unit 103 shown in FIG. 3A is formed as an evaporator, which comprises a top part 103-1 with an outlet 141, a bottom part 103-2 with an inlet 139, and a plurality of evaporating tubes 103-3 connecting the top part 103-1 with the bottom part 103-2. Further, the evaporating unit 103 shown in FIG. 3A comprises a plurality of optional evaporating fins 137, which increase the surface area of the evaporating unit 103, thereby increasing the efficiency of heat uptake of the evaporating unit 103.

Liquid cooling agent from the condensing unit 111 is adapted to enter the bottom part 103-2 of the evaporating unit through the inlet 139, and is adapted to flow from the bottom part 103-2 through the plurality of evaporating tubes 103-3 into the top part 103-1, and is adapted to exit the top part 103-1 through the outlet 141.

In the passive cooling mode, the flow of liquid cooling agent through the plurality of evaporating tubes 103-3 of the evaporating unit 103 is regulated in that way that the liquid cooling agent is completely evaporated.

In the active cooling mode, the flow of liquid cooling agent through the plurality of evaporating tubes 103-3 of the evaporating unit 103 is regulated in that way that the liquid cooling agent is at least partially evaporated, which means that the resulting partially evaporated cooling agent is present as a two-phase mixture comprising liquid cooling agent and gaseous cooling agent. The two-phase mixture comprising liquid cooling agent and gaseous cooling agent is then adapted to be conducted to the additional evaporator 135 shown in FIG. 3B where the complete evaporation of the mixture subsequently is performed in order to obtain only gaseous cooling agent.

The additional evaporator shown in FIG. 3B comprises an inlet 135-1, an outlet 135-2, and a single evaporating tube 135-3 connecting the inlet 135-1 with the outlet 135-2, wherein the single evaporating tube 135-3 comprises a meander shape. Further, the additional evaporator 135 comprises a plurality of optional evaporating fins 137.

Figure 4:
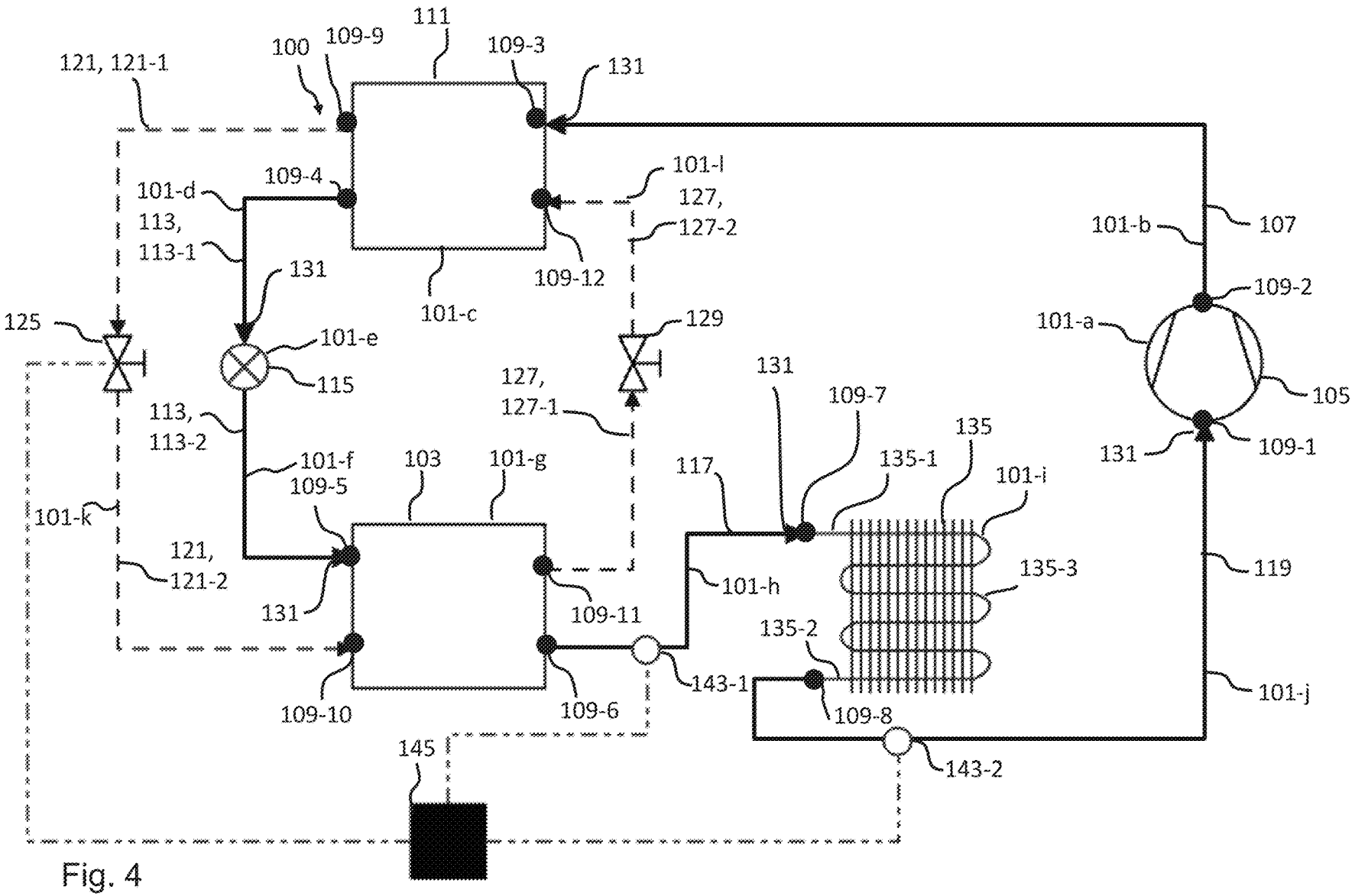
FIG. 4 is a schematic diagram of a cooling device comprising a cooling circuit during an active cooling mode according to an example.

FIG. 4 is a schematic diagram of a cooling device comprising a cooling circuit during an active cooling mode according to an example.

The cooling circuit 101 shown in the example according to FIG. 4 is identical to the cooling circuit 101 shown in the example according to FIG. 1 and FIG. 2, except for a control 145, which is connected to a first sensor arrangement 143-1 and to a second sensor arrangement 143-2.

The first sensor arrangement 143-1 is positioned in the third fluid line 117 connecting the evaporating unit 103 and the additional evaporator 135 and is adapted to detect a superheat of the cooling agent flowing through the third fluid line 117.

The second sensor arrangement 143-2 is positioned in the fourth fluid line 119 connecting the additional evaporator 135 with the compressor 105 and is adapted to detect a superheat of the cooling agent flowing through the fourth fluid line 119.

The control 145 is adapted to operate the first by-pass valve 125 in dependence of the superheat of the cooling agent flowing through the third fluid line 117 detected by the first sensor arrangement 143-1 and/or in dependence of the superheat of the cooling agent flowing through the fourth fluid line 119 detected by the second sensor arrangement 143-2.

While not shown in FIG. 4, the control 145 is optionally adapted to operate the expansion device 115 in dependence of the superheat of the cooling agent flowing through the third fluid line 117 detected by the first sensor arrangement 143-1 and/or in dependence of the superheat of the cooling agent flowing through the fourth fluid line 119 detected by the second sensor arrangement 143-2.

In an embodiment, the first and/or second sensor arrangement 143-1, 143-2 comprises a pressure sensor, which is adapted to detect a pressure of the cooling agent flowing through the third fluid line 117 and/or the fourth fluid line 119.

In an embodiment, the first and/or second sensor arrangement 143-1, 143-2 comprises a temperature sensor, which is adapted to detect a temperature of the cooling agent flowing through the third fluid line 117 and/or the fourth fluid line 119.

In an embodiment, the first and/or second sensor arrangement 143-1, 143-2 comprises both a pressure sensor and a temperature sensor.

In an embodiment, the control 145 is adapted to switch the expansion device 115 and/or the first by-pass valve 125 in an at least partially closed state to increase the flow rate of cooling agent, if the superheat is detected, wherein the superheat is defined by $\Delta T1=T1-TS1$. T1 is the temperature of the cooling agent in the third fluid line 117 and/or the additional evaporator 135 as measured by the temperature sensor of the first second sensor arrangement 143-1. TS1 is the evaporation temperature of the cooling agent inside the third fluid line 117 and/or the additional evaporator 135, wherein the control is adapted to determine TS1 based on the pressure of the cooling agent in the third fluid line 117 and/or the additional evaporator 135, wherein the pressure is measured by the pressure sensor of the first sensor arrangement 143-1.

In other words, the control 145 is adapted to switch the expansion device 115 and/or the first by-pass valve 125 in an at least partially closed state to increase the flow rate of cooling agent, if the detected superheat is above 0, in case that $\Delta T1>0$. If $\Delta T1=0$ or $\Delta T1<0$, the flow rate is not changed.

In particular, the control 145 is adapted to switch the expansion device 115 and/or first by-pass valve 125 in at least partially closed state to reduce the flow rate of cooling agent, if the detected superheat is below an additional superheat threshold, wherein the additional superheat threshold is defined by □T2=T2−TS2. TS2 is the saturation temperature of the cooling agent in the fourth fluid line 119, which is determined based on the pressure of the cooling agent in the fourth fluid line, wherein the pressure is measured by the pressure sensor of the second sensor arrangement 143-2. T2 is the temperature of the cooling agent flowing through the fourth fluid line 119, which is measured by the temperature sensor of the second sensor arrangement 143-2.

In particular, the control 145 is adapted to switch the expansion device 115 and/or first by-pass valve 125 in at least partially opened state to increase the flow rate of cooling agent, if the detected superheat is above an additional superheat threshold, wherein the additional superheat threshold is defined by □T2=T2−TS2. TS2 and T2 are defined as summarized above.

Due to the specific operation of the expansion device 115 and/or first by-pass valve 125 by the control 145, the flow rate of the cooling agent could be regulated in that way, that the temperature of the cooling agent on the outlet of the additional evaporator 135, i.e. the inlet of the compressor 105 is as close as possible to the superheat threshold, thereby allowing for a particularly effective evaporation process.

Figure 5:
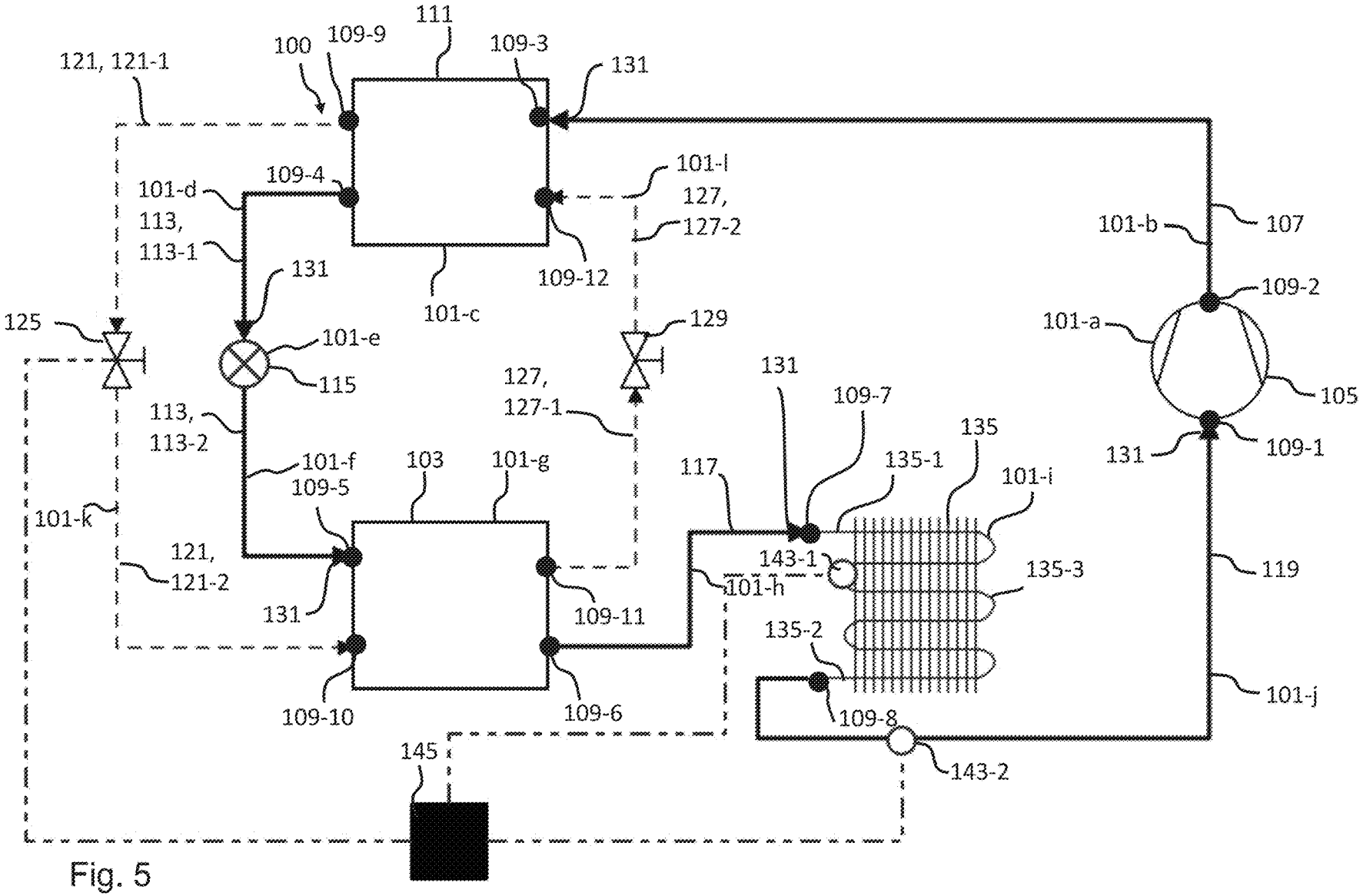
FIG. 5 is a schematic diagram of a cooling device comprising a cooling circuit during an active cooling mode according to an example.

FIG. 5 is a schematic diagram of a cooling device comprising a cooling circuit during an active cooling mode according to an example.

The cooling circuit 101 shown in the example according to FIG. 5 is identical to the cooling circuit 101 shown in the example according to FIG. 4, except for the difference that the first sensor arrangement 143-1 is positioned in the additional evaporator 135 instead of the third fluid line 117 as an alternative.

Reference to the details according to the example according to FIG. 4 is provided.

Figure 6:
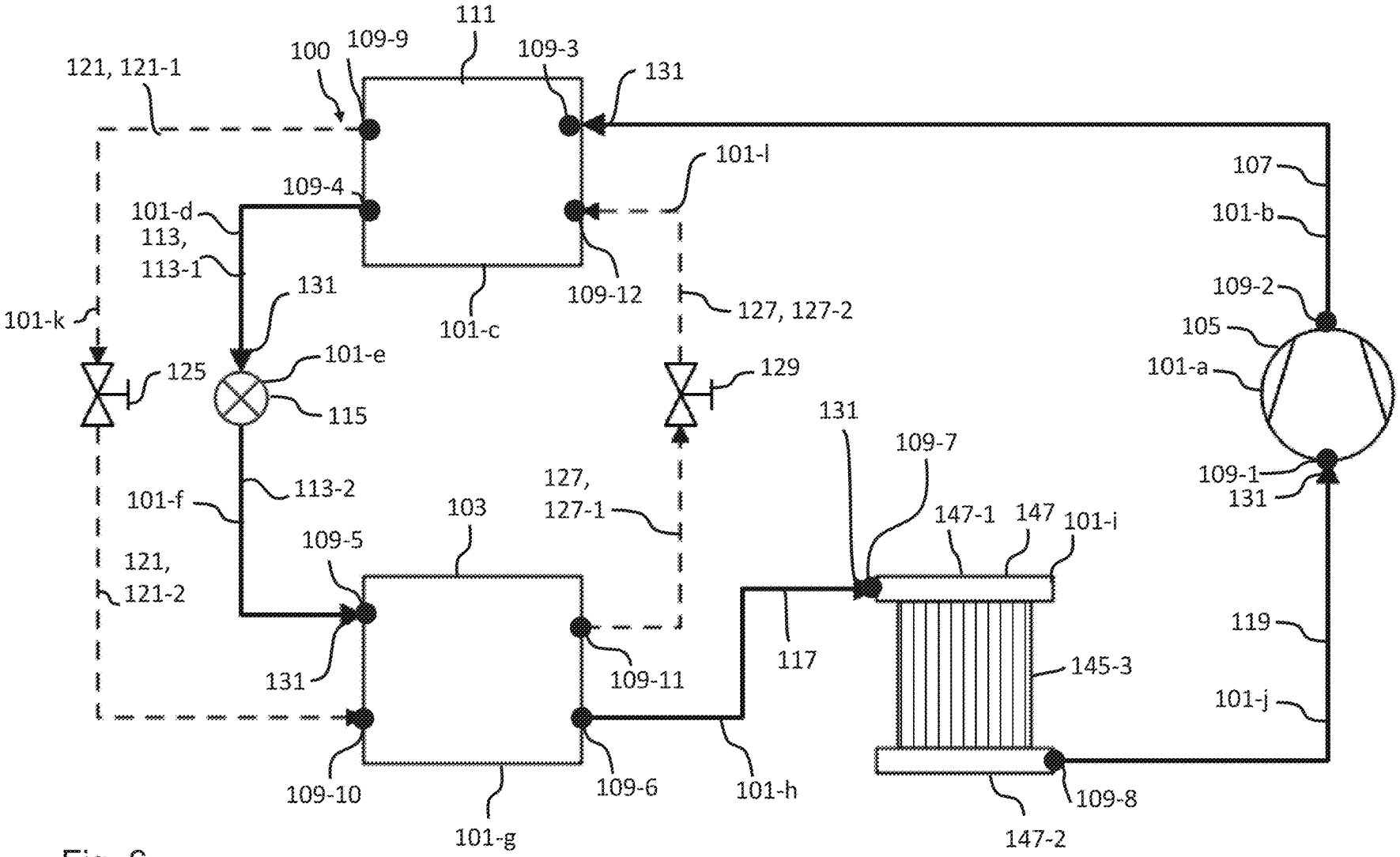
FIG. 6 is a schematic diagram of a cooling device comprising a cooling circuit during an active cooling mode according to an example.

FIG. 6 is a schematic diagram of a cooling device comprising a cooling circuit during an active cooling mode according to an example.

The cooling circuit 101 shown in the example according to FIG. 6 is related to the cooling circuit 101 shown in the example according to FIG. 1, except for the difference that the additional evaporator 145 comprises a top part 147-1, a bottom part 147-2 and a plurality of evaporating tubes 147-3 connecting the top part 147-1 with the bottom part 147-2, wherein the plurality of evaporating tubes 147-3 are vertically oriented.

Consequently during the active cooling mode, the partially evaporated cooling agent is adapted to enter the top part 147-1 of the additional evaporator 147 and subsequently flows down the plurality of evaporating tubes 147-3 before entering the bottom part 147-2 and subsequently entering the fourth fluid line 119. After complete evaporation of the cooling agent in the plurality of evaporating tubes 147-3 gaseous cooling agent and liquid lubricant oil is obtained, wherein the flow of the liquid lubricant oil down the plurality of evaporating tubes 147-3 is supported by the force of gravity thereby allowing for an effective removal of lubricant oil from the additional evaporator 147.

Figure 7:
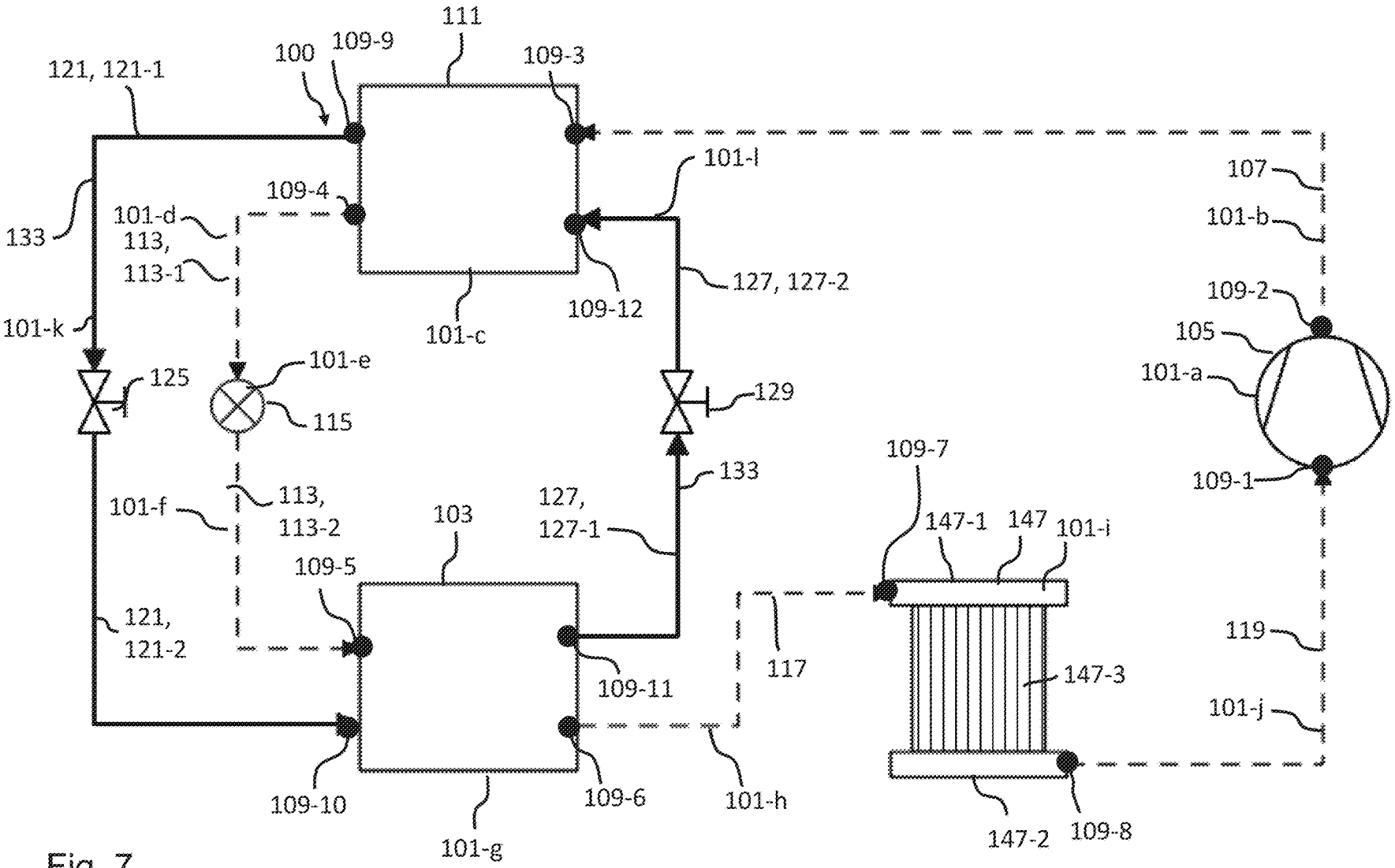
FIG. 7 is a schematic diagram of a cooling device comprising a cooling circuit during a passive cooling mode according to an example.

FIG. 7 is a schematic diagram of a cooling device comprising a cooling circuit during a passive cooling mode according to an example.

The cooling circuit 101 shown in the example according to FIG. 7 is identical to the cooling circuit 101 shown in the example according to FIG. 6, except for that in the example according to FIG. 7 the passive cooling mode is shown.

Figure 8:
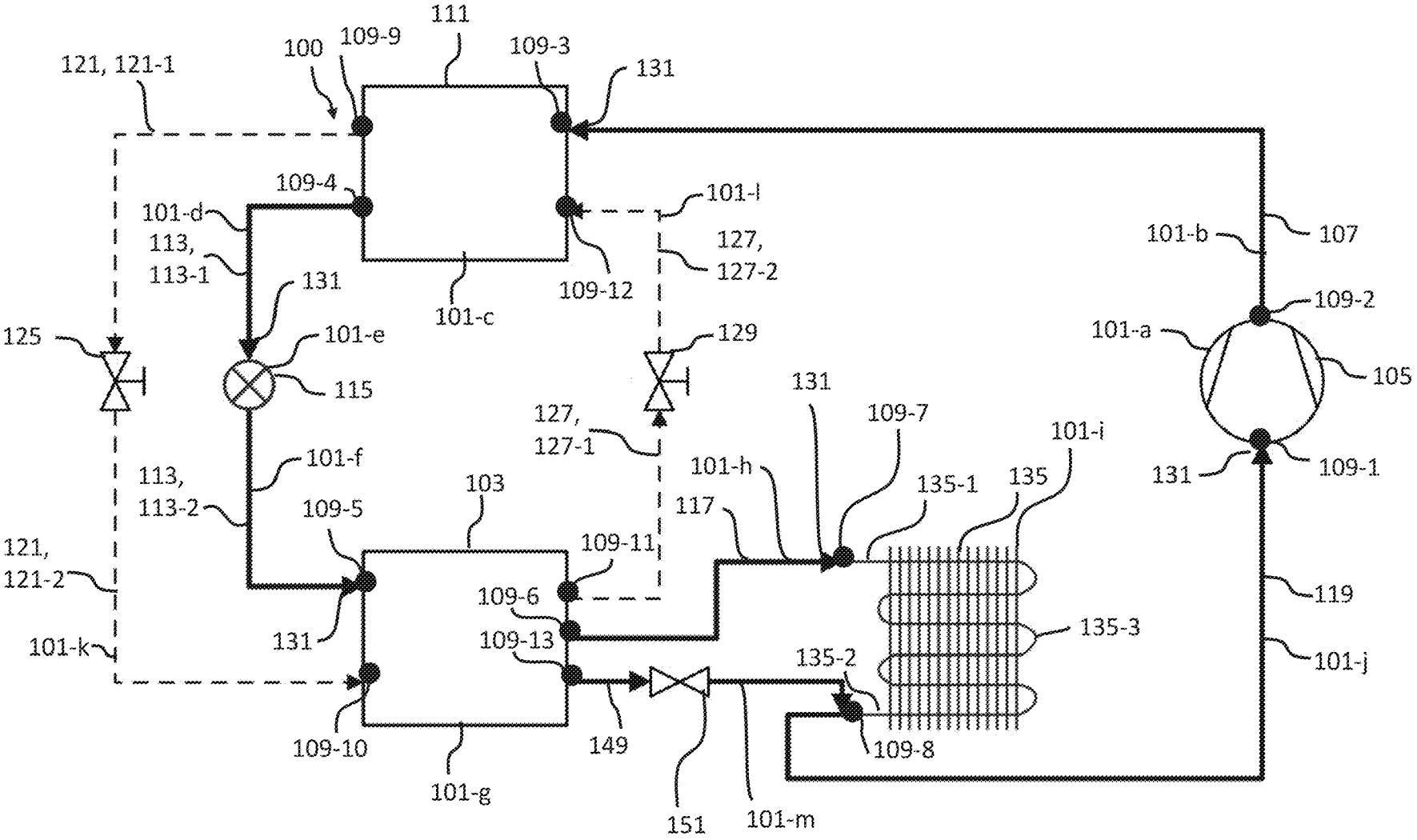
FIG. 8 is a schematic diagram of a cooling device comprising a cooling circuit during an active cooling mode according to an example.

FIG. 8 is a schematic diagram of a cooling device comprising a cooling circuit during an active cooling mode according to an example.

The cooling circuit 101 shown in the example according to FIG. 8 is related to the cooling circuit 101 shown in the example according to FIG. 1, except for that in the example according to FIG. 8 in addition to the third fluid line 117, an additional third fluid by-pass line 149 is present, which connects the evaporating unit 103 with the additional evaporator 135, wherein the third fluid by-pass line 149 comprises a flow-restricting element 151.

In an embodiment, the third fluid by-pass line 149, which forms a thirteenth section **101-*m* of the cooling circuit 101, is connected to the evaporating unit 103 at a thirteenth connection point 109-3, and is connected to the outlet 135-2 of the additional evaporator 103 at the eighth connection point 109-8. However, even if not shown in FIG. 8, the third fluid by-pass line 149 can be alternatively connected to the evaporating tube 135-3 of the additional evaporator 135**.

The third fluid by-pass line 149 with the flow restrictor 151 allows for an additional path between the evaporating unit 103 and the additional evaporator 135 to transfer lubricant oil away from the evaporating unit 103, e.g., when the third fluid by-pass line 149 is connected to a bottom part 103-2 of the evaporating unit 103.

Figure 9:
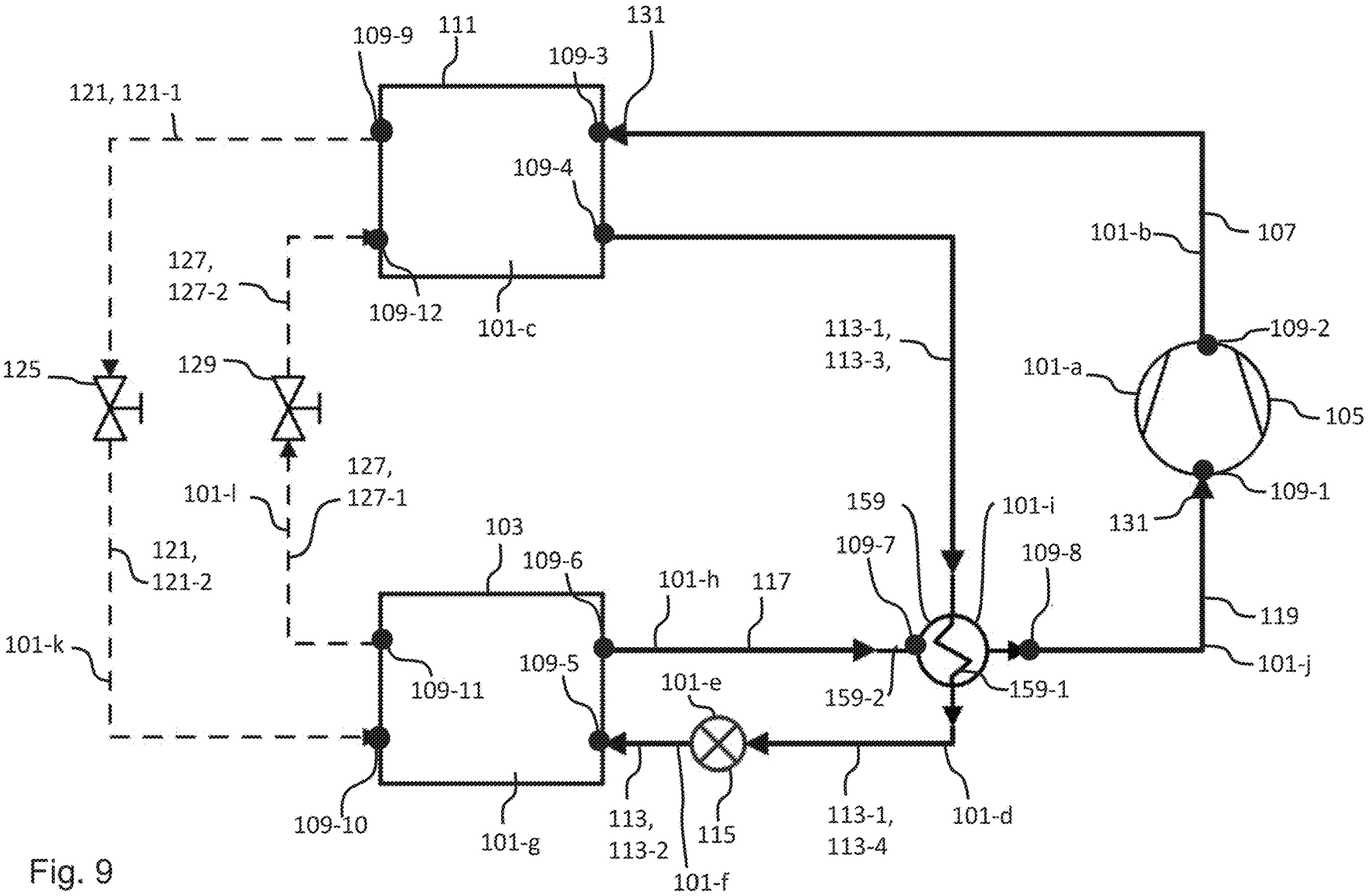
FIG. 9 is a schematic diagram of a cooling device comprising a cooling circuit during an active cooling mode according to an example.

FIG. 9 is a schematic diagram of a cooling device comprising a cooling circuit during an active cooling mode according to an example.

The cooling circuit 101 shown in the example according to FIG. 9 is related to the cooling circuit 101 shown in the example according to FIG. 1, except for that in the example according to FIG. 9 the additional evaporator 159 is formed as a regenerative heat exchanger.

As can be derived from FIG. 9, the additional evaporator 159, which is formed as a regenerative heat exchanger, comprises a first flow path 159-1, which connects a first condensing section 113-3 of the second fluid line 113 with a second condensing section 113-4 of the second fluid line 113. The second condensing section 113-4 of the second fluid line 113 is connected to the expansion device 115, wherein the expansion device 115 is connected to the evaporating unit 103 by the second section 113-2 of the second fluid line 103.

As can be derived from FIG. 9, the additional evaporator 159, which is formed as a regenerative heat exchanger, comprises a second flow-path 159-2, which connects the third fluid line 117 with the fourth fluid line 119.

The regenerative heat exchanger is adapted to transfer heat from the cooling agent flowing through the first flow-path 159-1 to the cooling agent flowing through the second flow-path 159-2.

Warm liquid cooling agent, which is adapted to flow from the condensing unit 111 through the first flow path 159-1, is adapted to transfer heat to the at least partially evaporated cooling agent, which is adapted to flow from the evaporating unit 103 through the second flow path 159-2, thereby decreasing the amount of heat, which is required at the additional evaporator 159 to completely evaporate the at least partially evaporated cooling agent. Therefore, the size of the additional evaporator 159, which is formed as a regenerative heat exchanger, can be significantly reduced.

Figure 10:
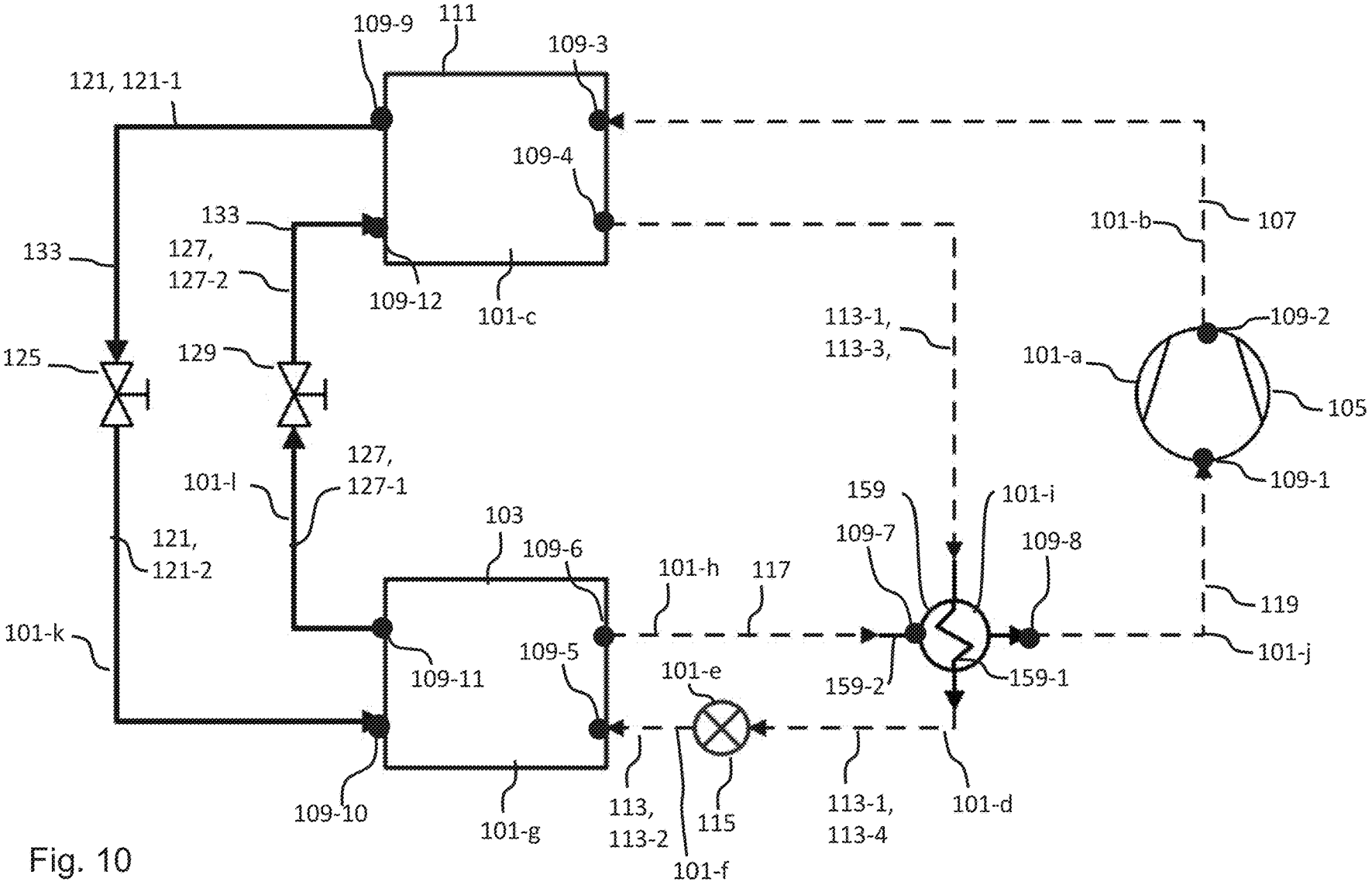
FIG. 10 is a schematic diagram of a cooling device comprising a cooling circuit during a passive cooling mode according to an example.

FIG. 10 is a schematic diagram of a cooling device comprising a cooling circuit during a passive cooling mode according to an example.

The cooling circuit 101 shown in the example according to FIG. 10 is identical to the cooling circuit 101 shown in the example according to FIG. 9, except for that in the example according to FIG. 10 the passive cooling mode is shown.

Figure 11:
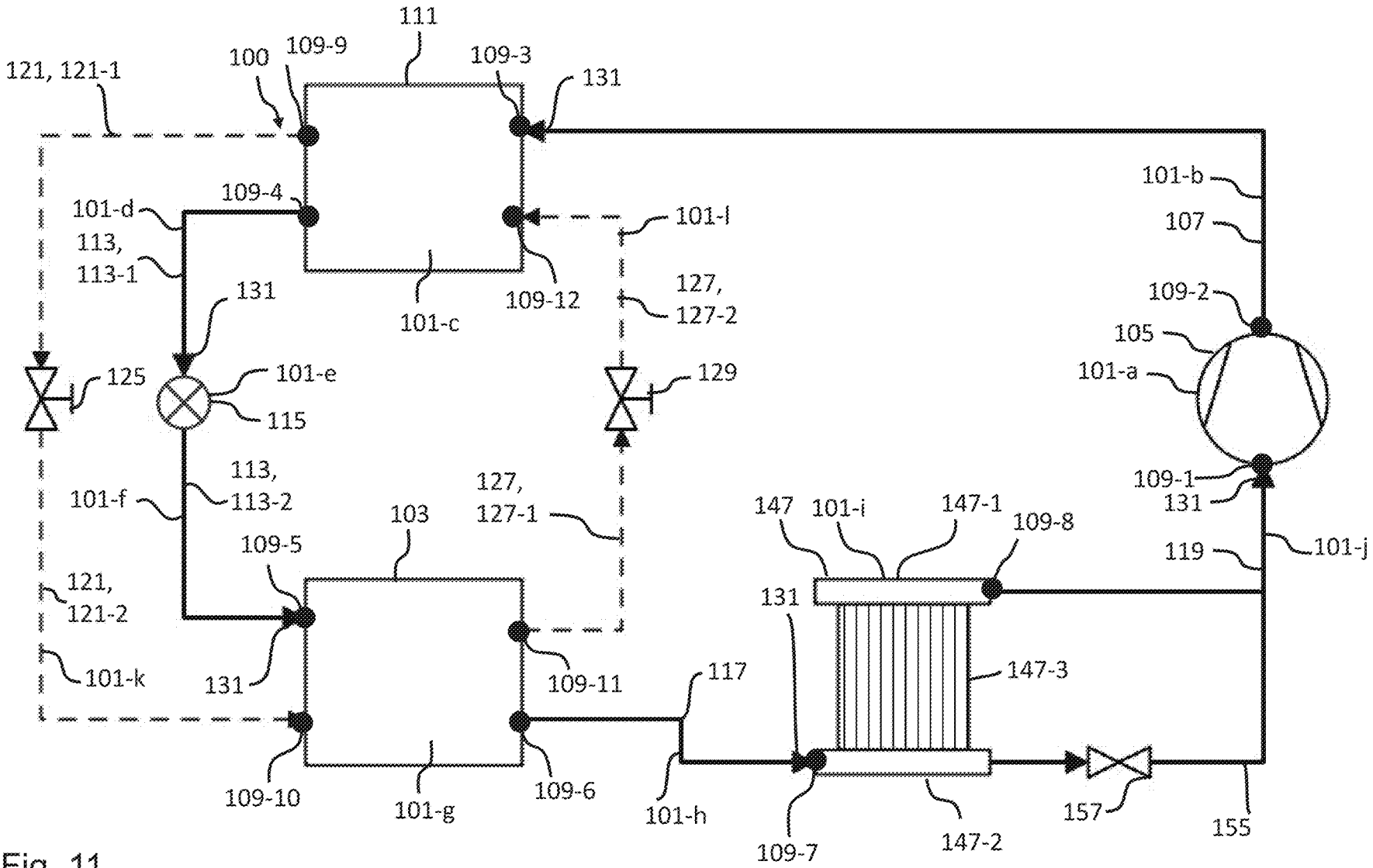
FIG. 11 is a schematic diagram of a cooling device comprising a cooling circuit during an active cooling mode according to an example.

FIG. 11 is a schematic diagram of a cooling device comprising a cooling circuit during an active cooling mode according to an example.

The cooling circuit 101 shown in the example according to FIG. 11 is related to the cooling circuit 101 shown in the example according to FIG. 6, except for that in the example according to FIG. 11 an oil release line 155 is present, which connects the additional evaporator 147 with the fourth fluid line 119.

As can be derived from FIG. 11, the bottom part 147-2 of the additional evaporator 147 is connected to the evaporating unit 135 by the third fluid line 117, wherein the top part 147-1 of the additional evaporator 147 is connected to the compressor 105 by the fourth fluid line 119 similar to the example according to FIG. 6.

However, as shown in the example according to FIG. 11, the oil release line 155 additionally connects the bottom part 147-2 of the additional evaporator 147 with the fourth fluid line 119. The oil release line 155 comprises a flow restricting element or oil release valve 157, which is adapted to close the oil release line 155 in order to retain lubricant oil in the bottom part 147-2 of the additional evaporator 147, and to open the oil release line 155, so that lubricant oil is adapted to flow from the bottom part 147-2 of the additional evaporator 147 through the oil release line 155 into the fourth fluid line 119.

By the oil release line 155 comprising a flow restricting element or oil release valve 157 any liquid lubricant oil, which maintains in the bottom part 147-2 of the additional evaporator 147 after the complete evaporation of cooling agent within the plurality of evaporating tubes 147-3, can be directly transferred into the fourth fluid line 119 and further to the compressor 105.

Figure 12:
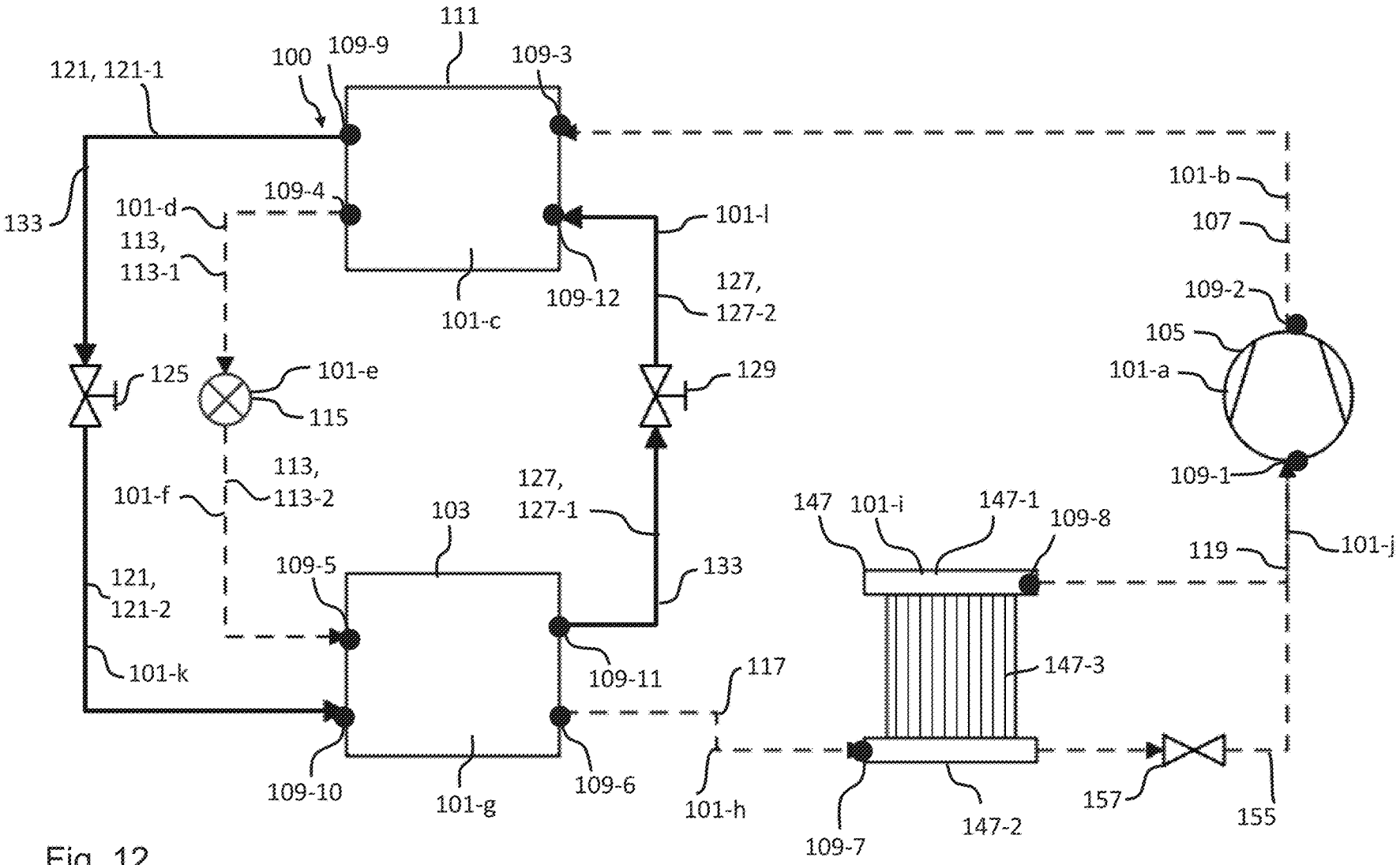
FIG. 12 is a schematic diagram of a cooling device comprising a cooling circuit during a passive cooling mode according to an example.

FIG. 12 is a schematic diagram of a cooling device comprising a cooling circuit during a passive cooling mode according to an example.

The cooling circuit 101 shown in the example according to FIG. 12 is identical to the cooling circuit 101 shown in the example according to FIG. 11, except for that in the example according to FIG. 10 the passive cooling mode is shown.

Figure 13:
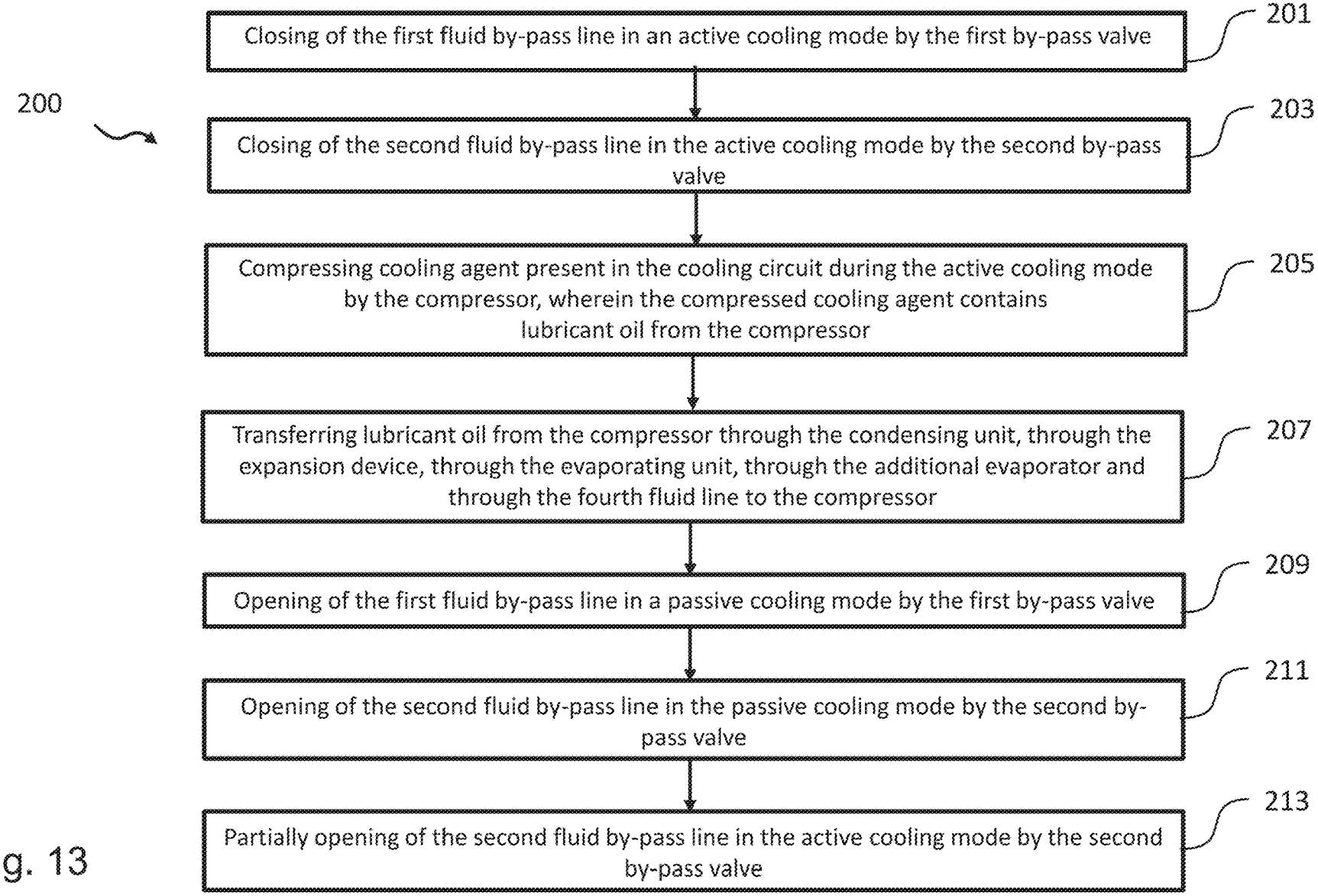
FIG. 13 is a flow diagram illustrating a method for cooling according to an example.

FIG. 13 is a flow diagram illustrating a method 200 for cooling according to an example.

The method 200 comprises the operations of:

Closing 201 of the first fluid by-pass line 121 in an active cooling mode by the first by-pass valve 125.

Closing 203 of the second fluid by-pass line 127 in the active cooling mode by the second by-pass valve 129.

Compressing 205 cooling agent present in the cooling circuit 101 during the active cooling mode by the compressor 105, wherein the compressed cooling agent contains lubricant oil from the compressor 105.

Transferring 207 lubricant oil from the compressor 105 through the condensing unit 111, through the expansion device 115, through the evaporating unit 103, through the additional evaporator 135, 147, 159 and through the fourth fluid line 119 back to the compressor 105 in the active cooling mode.

In an embodiment, the method comprises the optional method operations of opening 209 of the first fluid by-pass line 121 in a passive cooling mode by the first by-pass valve 125, and opening 211 of the second fluid by-pass line 127 in the passive cooling mode by the second by-pass valve 129, so that the cooling agent directly flows from the condensing unit 111 through the first fluid by-pass line 121 to the evaporating unit 103, and through the second fluid by-pass line 127 back to the condensing unit 111.

In an embodiment, the method comprises the optional method operation of partially opening 213 of the second fluid by-pass line 127 in the active cooling mode by the second by-pass valve 129, so that lubricant oil is transferred from the condensing unit 111 back to the compressor 105.

Further features of the method 200 result directly from the structure and/or functionality of the cooling device 100, respectively cooling circuit 101 as well as its different examples described above.

The person skilled in the art will understand that the "blocks" ("units") of the various figures (method and apparatus) represent or describe functionalities of examples of the present disclosure (rather than necessarily individual "units" in hardware or software) and thus describe equally functions or features of apparatus examples as well as method examples (unit=operation).

In the several examples provided in the present invention, it should be understood that the disclosed apparatus, and method may be implemented in other manners. For example, the described examples of an apparatus are merely exemplary.

The invention claimed is:

1. A cooling device comprising a cooling circuit, the cooling circuit comprising:

a compressor, which is adapted to compress cooling agent present in the cooling circuit in an active cooling mode, wherein the compressed cooling agent contains lubricant oil from the compressor;

a condensing unit, which is connected to the compressor by a first fluid line of the cooling circuit;

an evaporating unit, which is connected to the condensing unit by a second fluid line of the cooling circuit;

an expansion device, which is arranged in the second fluid line;

an additional evaporator, which is connected to the evaporating unit by a third fluid line of the cooling circuit, and which is connected to the compressor by a fourth fluid line of the cooling circuit, wherein the cooling device, in the active cooling mode, is configured to transfer lubricant oil from the compressor through the condensing unit, through the expansion device, through the evaporating unit, through the additional evaporator and through the fourth fluid line back to the compressor;

a first fluid by-pass line, which connects the condensing unit with the evaporating unit; and a second fluid by-pass line, which connects the evaporating unit with the condensing unit, wherein the first fluid by-pass line comprises a first by-pass valve and wherein the second fluid by-pass line comprises a second by-pass valve, which are adapted to close the first fluid by-pass line and the second fluid by-pass line in the active cooling mode, respectively.

2. The cooling device according to claim 1, wherein in the active cooling mode the compressor is adapted to compress gaseous cooling agent, wherein the compressed gaseous cooling agent is adapted to be conducted together with the lubricant oil through the first fluid line to the condensing unit, wherein the condensing unit is adapted to condensate the compressed gaseous cooling agent and to obtain liquid cooling agent, wherein the obtained liquid cooling agent is adapted to be conducted together with the lubricant oil through the second fluid line and through the expansion device to the evaporating unit, wherein the evaporating unit is adapted to at least partially evaporate the liquid cooling agent and to obtain a mixture of gaseous and liquid cooling agent, wherein the obtained mixture of gaseous and liquid cooling agent is adapted to be conducted together with the lubricant oil through the third fluid line to the additional evaporator, wherein the additional evaporator is adapted to completely evaporate the liquid cooling agent and to obtain gaseous cooling agent, wherein the obtained gaseous cooling agent is adapted to be conducted through the fourth fluid line back to the compressor.

3. The cooling device according to claim 1, wherein in the active cooling mode the first by-pass valve and the second by-pass valve are adapted to completely close the first fluid by-pass line and the second fluid by-pass line, respectively, or wherein in the active cooling mode the first by-pass valve is adapted to completely close the first fluid by-pass line and the second by-pass valve is adapted to partially close the second fluid by-pass line, by decreasing a cross-section of the second fluid by-pass line between 1% and 99%.

4. The cooling device according to claim 1, wherein in a passive cooling mode the compressor is adapted to be deactivated, wherein in the passive cooling mode the first by-pass valve and the second by-pass valve are adapted to open the first fluid by-pass line and the second fluid by-pass line, respectively, wherein in the passive cooling mode the cooling agent is adapted to directly flow from the condensing unit through the first fluid by-pass line, through the evaporating unit, and through the second fluid by-pass line back to the condensing unit.

5. The cooling device according to claim 1, wherein the cooling device comprises a control, wherein the third fluid line or the additional evaporator comprises a first sensor arrangement, which is adapted to detect a superheat of the cooling agent flowing through the third fluid line or through the additional evaporator, and wherein the control is adapted to operate the expansion device and/or the first by-pass valve in dependence of the detected superheat of the cooling agent.

6. The cooling device according to claim 1, wherein the cooling device comprises a control, wherein the third fluid line comprises a first sensor arrangement, which is adapted to detect a void fraction X of the cooling agent flowing through the third fluid line, and wherein the control is adapted to operate the expansion device and/or the first by-pass valve in dependence of the detected void fraction X of the cooling agent.

7. The cooling device according to claim 5, wherein the fourth fluid line comprises a second sensor arrangement, which is adapted to detect a superheat of the cooling agent flowing through the fourth fluid line, and wherein the control is adapted to operate the expansion device and/or the first by-pass valve in dependence of the detected superheat.

8. The cooling device according to claim 1, wherein the evaporating unit comprises a top part, a bottom part, and a plurality of evaporating tubes connecting the top part with the bottom part, wherein the bottom part is connected to the condensing unit by the second fluid line, and wherein the top part is connected to the third fluid line.

9. The cooling device according to claim 1, wherein the additional evaporator comprises an inlet, which is connected to the third fluid line, and wherein the additional evaporator comprises an outlet, which is connected to the fourth fluid line, wherein the inlet is connected to the outlet of the additional evaporator by at least one evaporating tube of the additional evaporator.

10. The cooling device according to claim 1, wherein the additional evaporator comprises a top part, a bottom part, and a plurality of evaporating tubes connecting the top part with the bottom part, wherein the top part or bottom part of the additional evaporator is connected to the evaporating unit by the third fluid line, and wherein the bottom part or top part of the additional evaporator is connected to the compressor by the fourth fluid line.

11. The cooling device according to claim 10, wherein the bottom part of the additional evaporator is connected to the evaporating unit by the third fluid line, wherein the top part of the additional evaporator is connected to the compressor by the fourth fluid line, the cooling circuit further comprising an oil release line, which connects the bottom part of the additional evaporator with the fourth fluid line, wherein the oil release line comprises a flow restricting element or oil release valve, which is adapted to close the oil release line and to retain lubricant oil in the bottom part of the additional evaporator, and to open the oil release line, wherein lubricant oil is adapted to flow from the bottom part of the additional evaporator through the oil release line into the fourth fluid line.

12. The cooling device according to claim 1, wherein the additional evaporator is formed as a regenerative heat exchanger, comprising a first flow-path, which connects a first condensing section of the second fluid line with a second condensing section of the second fluid line, and comprising a second flow-path, which connects the third fluid line with the fourth fluid line, wherein the regenerative heat exchanger is adapted to transfer heat from the cooling agent flowing through the first flow-path to the cooling agent flowing through the second flow-path.

13. The cooling device according to claim 1, the cooling circuit further comprising a third fluid by-pass line, which connects the evaporating unit with the additional evaporator, wherein the third fluid by-pass line comprises a flow-restricting element.

14. The cooling device according to claim 13, wherein the third fluid by-pass line connects the evaporating unit with a bottom part of the additional evaporator, with an outlet of the additional evaporator or with an outlet of the additional evaporator, which is formed as a regenerative heat exchanger.

15. The cooling device according to claim 13, wherein the third fluid by-pass line connects the evaporating unit with at least one of a plurality of evaporating tubes of the additional evaporator, with at least one evaporating tube of the additional evaporator, or with a second flow path of the additional evaporator, which is formed as a regenerative heat exchanger.

16. The cooling device according to claim 1, wherein during the active cooling mode the second fluid by-pass line is adapted to transfer lubricant oil from condensing unit back to the compressor.

17. A method for cooling by using a cooling circuit of a cooling device, comprising:

closing of a first fluid by-pass line of the cooling circuit by a first by-pass valve when the cooling device is in an active cooling mode, wherein the cooling circuit comprises a compressor, a condensing unit connected to the compressor by a first fluid line of the cooling circuit, an evaporating unit connected to the condensing unit by a second fluid line of the cooling circuit, an expansion device arranged in the second fluid line, an additional evaporator connected to the evaporating unit by a third fluid line of the cooling circuit, and connected to the compressor by a fourth fluid line of the cooling circuit, the first fluid by-pass line connecting the condensing unit with the evaporating unit, and a second fluid by-pass line connecting the evaporating unit with the condensing unit, wherein the first fluid by-pass line comprises the first by-pass valve, and wherein the second fluid by-pass line comprises a second by-pass valve;

closing of the second fluid by-pass line in the active cooling mode by the second by-pass valve, compressing cooling agent present in the cooling circuit in the active cooling mode by the compressor, wherein the compressed cooling agent contains lubricant oil from the compressor, and transferring at least a portion of the lubricant oil from the compressor through the condensing unit, through the expansion device, through the evaporating unit, through the additional evaporator and through the fourth fluid line back to the compressor in the active cooling mode.

18. The method of claim 17, the method further comprising:

opening the first fluid by-pass line in a passive cooling mode by the first by-pass valve, and opening the second fluid by-pass line in the passive cooling mode by the second by-pass valve, wherein the cooling agent directly flows from the condensing unit through the first fluid by-pass line to the evaporating unit, and through the second fluid by-pass line back to the condensing unit.

19. The method of claim 17, further comprising:

partially opening the second fluid by-pass line in the active cooling mode by the second by-pass valve, wherein at least a portion of the lubricant oil is transferred from the condensing unit back to the compressor.

* * * * *